US011493200B2

(12) United States Patent
Pannullo et al.

(10) Patent No.: US 11,493,200 B2
(45) Date of Patent: Nov. 8, 2022

(54) LIQUID FUEL BURNING TORCH SYSTEM WITH AUTOMATIC FUEL REPLENISHMENT AND FLAME EXTINGUISHMENT

(71) Applicant: Joseph Pannullo, Essex Fells, NJ (US)

(72) Inventors: Joseph Pannullo, Essex Fells, NJ (US); Joseph Correia, Cedar Grove, NJ (US)

( * ) Notice: Subject to any disclaimer, the term of this patent is extended or adjusted under 35 U.S.C. 154(b) by 0 days.

(21) Appl. No.: 17/752,152

(22) Filed: May 24, 2022

(65) Prior Publication Data

US 2022/0290854 A1 Sep. 15, 2022

Related U.S. Application Data

(63) Continuation-in-part of application No. PCT/US2022/013950, filed on Jan. 26, 2022, and a continuation-in-part of application No. 17/585,463, filed on Jan. 26, 2022, which is a continuation-in-part of application No. 17/138,322, filed on Dec. 30, 2020, application No. 17/752,152, which is a continuation-in-part of application No.
(Continued)

(51) Int. Cl.
*F21V 37/00* (2006.01)
*F21S 15/00* (2006.01)

(52) U.S. Cl.
CPC ..... *F21V 37/0054* (2013.01); *F21S 15/00* (2013.01); *F21V 37/0012* (2013.01)

(58) Field of Classification Search
CPC ..... F21V 37/0054; F21V 37/012; F21S 15/00
See application file for complete search history.

(56) References Cited

U.S. PATENT DOCUMENTS 52,618 A 2/1866 Stansell
143,143 A 9/1873 Hallas
(Continued)

FOREIGN PATENT DOCUMENTS

EP 96111 A2 12/1983
JP 63201422 A 8/1988
(Continued)

OTHER PUBLICATIONS

Notice of Allowance for U.S. Appl. No. 17/585,463, dated Jun. 23, 2022, 12 Pages.
(Continued)

*Primary Examiner* — Avinash A Savani
*Assistant Examiner* — Deepak A Deean
(74) *Attorney, Agent, or Firm* — Maine Cernota & Rardin

(57) ABSTRACT

A liquid fuel burning torch system maintains fuel within one or more torches by pumping fuel from a central reservoir to the torches via a plumbing system. The torches can be extinguished by reversing the flow of the fuel in the plumbing system, for example by reversing a pumping direction of the pump, switching pumps, or actuating flow reversal valves. The torches can include remotely controlled torch igniting mechanisms, wireless access for remote torch monitoring and/or control, and/or heat sensors for determining whether the torch is burning. The torches can include fuel overfill prevention (FOP) valves. A flow of fuel through the FOP valves can be directed so as to avoid impinging on plugs of the FOP valves. The FOP valves can include check valves that allow fuel to be drained from the torches even when the FOP valves are closed.

21 Claims, 23 Drawing Sheets

Related U.S. Application Data

PCT/US2020/062120, filed on Nov. 25, 2020, said application No. 17/138,322 is a continuation-in-part of application No. PCT/US2020/062120, filed on Nov. 25, 2020, which is a continuation-in-part of application No. 17/023,957, filed on Sep. 17, 2020, application No. 17/752,152, which is a continuation-in-part of application No. 17/023,957, filed on Sep. 17, 2020, which is a continuation-in-part of application No. 16/928,767, filed on Jul. 14, 2020, now Pat. No. 10,842,146, said application No. PCT/US2020/062120 is a continuation-in-part of application No. 16/928,767, filed on Jul. 14, 2020, now Pat. No. 10,842,146.

(60) Provisional application No. 63/208,811, filed on Jun. 9, 2021, provisional application No. 63/142,225, filed on Jan. 27, 2021.

(56) References Cited

U.S. PATENT DOCUMENTS

| | | | |
|---|---|---|---|
| RE6,844 | E | 1/1876 | Ambrose |
| 252,195 | A | 1/1882 | Decker |
| 262,804 | A | 8/1882 | Marichenski |
| 372,020 | A | 10/1887 | Hardcastle |
| 418,113 | A | 12/1889 | Marzo |
| 594,264 | A | 11/1897 | Miller |
| 771,567 | A | 10/1904 | O'Brien |
| 826,423 | A | 7/1906 | Haden |
| 945,569 | A | 1/1910 | Millea |
| 1,142,816 | A | 6/1915 | Kaufman |
| 1,161,745 | A | 11/1915 | Springman |
| 1,259,791 | A | 3/1918 | Simmons |
| 1,310,560 | A | 7/1919 | Cook |
| 1,349,267 | A | 8/1920 | Craig |
| 1,391,956 | A | 9/1921 | Henry |
| 1,442,228 | A | 1/1923 | La Salle |
| 1,763,164 | A | 6/1930 | Lavigne |
| 1,790,480 | A | 1/1931 | Macomber |
| 1,905,918 | A | 4/1933 | Lennmor |
| 2,197,686 | A | 4/1940 | Flutsch |
| 2,210,751 | A | 8/1940 | Cronkhite |
| 2,276,039 | A | 3/1942 | Horther |
| 2,495,230 | A | 1/1950 | Day et al. |
| 2,499,118 | A | 2/1950 | Sipes |
| 2,604,113 | A | 7/1952 | Barsano |
| 3,817,686 | A | 6/1974 | Quittner |
| 4,193,417 | A | 3/1980 | Bowman |
| 4,417,870 | A | 11/1983 | Nakamura |
| 4,470,433 | A | 9/1984 | Vipond |
| 4,477,247 | A | 10/1984 | Kumasaka |
| 4,582,478 | A | 4/1986 | Hilker |
| 4,667,278 | A | 5/1987 | Poyer |
| 4,835,663 | A | 5/1989 | Abbott et al. |
| 4,847,192 | A | 7/1989 | Fujimoto |
| 4,974,134 | A | 11/1990 | Bourne |
| 5,057,005 | A | 10/1991 | Kwok |
| 5,263,794 | A | 11/1993 | Webb |
| 5,297,896 | A | 3/1994 | Webb |
| 5,472,340 | A | 12/1995 | Lynch |
| 5,540,250 | A | 7/1996 | Mullins |
| 5,932,842 | A | 8/1999 | Eberl |
| 5,980,238 | A | 11/1999 | Collins, Sr. |
| 6,006,773 | A | 12/1999 | Bravo |
| 6,370,738 | B1 | 4/2002 | Dion, Jr. |
| 6,579,090 | B1 | 6/2003 | Taubitz |
| 6,746,235 | B1 | 6/2004 | Aszenbrenner et al. |
| 8,191,932 | B2 | 6/2012 | Davis |
| 8,390,981 | B1 | 3/2013 | Treadaway |
| 8,435,029 | B2 | 5/2013 | Masterson et al. |
| 8,823,714 | B1 | 9/2014 | Thielvoldt |
| 9,249,897 | B2 | 2/2016 | Acosta |
| 9,267,681 | B2 | 2/2016 | Barudi et al. |
| 9,810,426 | B2 | 11/2017 | Bauswell et al. |
| 10,317,077 | B2 | 6/2019 | Hansen et al. |
| 10,378,754 | B1 | 8/2019 | Durrence |
| 10,393,379 | B2 | 8/2019 | Lev |
| 10,485,367 | B2 | 11/2019 | Kopolowitz |
| 10,842,146 | B1 | 11/2020 | Pannullo |
| 11,209,160 | B2 | 12/2021 | Wu |
| 11,266,141 | B1 | 3/2022 | Chojnacki |
| 2002/0146656 | A1 | 10/2002 | Thigpen et al. |
| 2003/0036030 | A1 | 2/2003 | Doppelt |
| 2005/0104371 | A1 | 5/2005 | Atkinson |
| 2006/0134571 | A1 | 6/2006 | St-Germain |
| 2007/0160944 | A1 | 7/2007 | Knight |
| 2011/0198550 | A1 | 8/2011 | Howard |
| 2011/0198551 | A1 | 8/2011 | Howard |
| 2012/0258412 | A1 | 10/2012 | Jackow |
| 2012/0282559 | A1 | 11/2012 | Barudi et al. |
| 2013/0027918 | A1 | 1/2013 | White |
| 2013/0101946 | A1 | 4/2013 | Masterson et al. |
| 2013/0114244 | A1 | 5/2013 | Formico |
| 2013/0149651 | A1 | 6/2013 | Thielvoldt |
| 2014/0134546 | A1 | 5/2014 | Masterson et al. |
| 2014/0362560 | A1 | 12/2014 | Formico |
| 2014/0366262 | A1 | 12/2014 | Flynn |
| 2014/0371927 | A1 | 12/2014 | Pooladsanj |
| 2015/0047627 | A1 | 2/2015 | Thielvoldt |
| 2015/0144713 | A1 | 5/2015 | Formico |
| 2016/0113094 | A1 | 4/2016 | Wagner et al. |
| 2016/0286627 | A1 | 9/2016 | Chen et al. |
| 2017/0254532 | A1 | 9/2017 | Bauswell |
| 2017/0268775 | A1 | 9/2017 | Lev |
| 2018/0072965 | A1 | 3/2018 | Han |
| 2019/0117816 | A1 | 4/2019 | Dycher |
| 2019/0242577 | A1 | 8/2019 | Mann |
| 2020/0003412 | A1 | 1/2020 | Bianchini |
| 2021/0071855 | A1 | 3/2021 | Pan |

FOREIGN PATENT DOCUMENTS

| | | | |
|---|---|---|---|
| JP | 2003343837 | A | 5/2002 |
| JP | 2006289266 | A | 10/2006 |
| WO | 2011046287 | A2 | 4/2011 |

OTHER PUBLICATIONS

Office Action for U.S. Appl. No. 17/023,957 dated Aug. 4, 2022, 49 pages.
Advisory Office Action for U.S. Appl. No. 17/138,322, dated Aug. 27, 2021, 4 Pages.
Final Office Action for U.S. Appl. No. 17/138,322 dated Mar. 15, 2022, 21 pages.
Final Office Action for U.S. Appl. No. 17/138,322 dated Jun. 17, 2021, 27 pages.
International Search Report and Written Opinion for PCT Appl. No. PCT/US2020/062120, dated Apr. 15, 2021, 15 Pages.
International Search Report and Written Opinion for PCT Appl. No. PCT/US2022/013950, dated May 4, 2022, 13 pages.
Notice of Allowance for U.S. Appl. No. 16/928,767, dated Oct. 2, 2020, 5 Pages.
Office Action for U.S. Appl. No. 17/138,322, dated Mar. 2, 2021, 6 Pages.
Office Action for U.S. Appl. No. 17/138,322, dated Sep. 24, 2021, 20 Pages.
Office Action for U.S. Appl. No. 17/138,322, dated Mar. 30, 2021, 21 Pages.
Office Action for U.S. Appl. No. 17/585,463 dated May 10, 2022, 15 pages.
Office Actions for U.S. Appl. No. 16/928,767, dated Sep. 11, 2020, 29 Pages.

LIQUID FUEL BURNING TORCH SYSTEM WITH AUTOMATIC FUEL REPLENISHMENT AND FLAME EXTINGUISHMENT

RELATED APPLICATIONS

This application is a continuation in part of U.S. application Ser. No. 17/585,463 filed Jan. 26, 2022. This application is also a continuation in part of U.S. patent application Ser. No. 17/138,322, filed on Dec. 30, 2020, and of U.S. patent application Ser. No. 17/023,957, filed Sep. 17, 2020. This application also claims the benefit of U.S. Provisional Application No. 63/208,811, filed Jun. 9, 2021. This application is also a continuation in part of international patent application PCT/US20/62120, filed Nov. 25, 2020 and of international patent application PCT/US22/13950, filed Jan. 26, 2022. U.S. patent application Ser. No. 17/585,463 claims the benefit of U.S. Provisional Application No. 63/142,225, filed Jan. 27, 2021, and of U.S. Provisional Application No. 63/208,811, filed Jun. 9, 2021. U.S. patent application Ser. No. 17/138,322 is a continuation in part of international patent application PCT/US20/62120. U.S. patent application Ser. No. 17/023,957 is a continuation in part of U.S. patent application Ser. No. 16/928,767, filed Jul. 14, 2020, now U.S. Pat. No. 10,842,146, issued Nov. 24, 2020. International patent application PCT/US20/62120 is a continuation in part of U.S. application Ser. No. 17/023,957. PCT/US20/62120 also is a continuation in part of U.S. application Ser. No. 16/928,767. International patent application PCT/US22/13950 claims the benefit of U.S. Provisional Application No. 63/142,225 and of U.S. Provisional Application No. 63/208,811.

FIELD OF THE INVENTION

The invention relates to outdoor torches that burn a liquid fuel, and more particularly, to torches that are automatically refueled with the liquid fuel.

BACKGROUND OF THE INVENTION

The enjoyment of outdoor activities during periods of warm weather has always been highly popular. Furthermore, the emergence of SARS-CoV-2 greatly increased and expanded the use of outdoor areas, both for private gatherings, for restaurant outdoor dining, and for many commercial activities. At least some of this increase in outdoor activities is likely to continue long beyond the end of the pandemic.

It is often desirable for an outdoor activity to extend into hours after dark, in which case lighting of some sort is needed. One possibility is to provide conventional electric lights, but often this approach does not provide an optimal ambiance. Instead, some outdoor venues, such as patio venues at hotels, resorts, etc., provide gas fueled torches that are interlinked by a gas plumbing system and permanently installed in areas where outdoor evening activities are hosted. This approach has the advantage that the torches can all be easily extinguished simply by shutting off the supply of gas to the gas pipes included in the gas plumbing system.

However, gas-fueled torches can be expensive to operate. Also, gas-fueled torches can pose a safety hazard, in that any leakage of gas could be highly dangerous if it is somehow ignited. For example, if sufficient leaked gas accumulates in the vicinity of a burning torch, and then is ignited by the torch, the result can be an explosive burst of flame.

Also, installation of a gas plumbing system typically requires employment of a licensed plumber, in addition to municipal permitting and connection of the gas plumbing system to a gas utility hookup. In some regions, such as arid areas and dry forested locations, gas torches can greatly increase the risk of wild fires in areas where dead leaves and/or other dried vegetation is present. As a result, many local ordinances discourage the installation of gas pipelines, such that it can be difficult to obtain the required permits to install and operate outdoor gas torches, especially when a large quantity of interlinked gas torches are to be installed.

Furthermore, outdoor activities are often hindered by the prevalence of insect pests, which can include swarming insects such as gnats, as well as biting insects such as black flies and mosquitos. In fact, mosquitos are the greatest menace for spreading diseases like dengue, malaria, yellow fever, zika, West Nile, and many others, causing millions of deaths each year. More than 35% of the world population lives in an area where the risk of diseases such as dengue is high.

According to the statistics of the United States CDC (Center for Disease Control and Prevention) published in the year 2019, the incidence of dengue, has risen by a factor of over the past 30 years, worldwide. The report also states that the parasite disease called lymphatic filariasis that is transmitted by repeated mosquito bites over a period of a few months affects more than 120 million people in approximately 72 different countries.

Global warming is also increasing the problem of insect pests in outdoor areas, because higher temperatures provide optimum conditions for mosquitoes to breed, and increases their level of activeness.

Accordingly, there is also a pressing need to expand ways to provide outdoor spaces for patrons and workers with minimal risk of hinderance by insect pests.

One approach to avoiding bites by insects is to apply an insect repellent directly to the skin. However, this approach is sometimes undesirable, because of the residue that remains on the skin after the outdoor activity has concluded, as well as a reluctance to spend time applying the repellent and subsequently washing the repellent off again.

Furthermore, repellents applied to the skin may fail to provide adequate protection from insects, for example if there is an inadvertent failure to apply the repellent to certain skin regions. Furthermore, some insects, such as mosquitos, are frequently able to bite a victim through clothing, on the scalp through hair, or at a location where the hair is parted and the underlying scalp is exposed.

Many outdoor activities, such as barbecues and outdoor restaurant services, take place in relatively limited areas, such as on a deck or patio, or in a limited region that has been set aside specifically for such activities. One approach in such cases is to spray the area with an insecticide or repellent before the activity begins. Systems exist that provide permanently installed insecticide misting jets fed from a central tank of insecticide, intended for periodic, automated misting of an outdoor area with insecticide. However, insecticides are toxic and noxious, and are therefore limited to application when an outdoor area is not in use.

Furthermore, the use of pesticide spray is inappropriate in an open table dining environment, in part because insecticides can leave a toxic residue on tables, chairs, and other surfaces. In addition, pesticides are mainly effective at the time of application, because they lose most of their ability to kill pests as they disburse and dry. To the extent that pesticides may have any long-term effectiveness, that benefit is lost if the pesticide residue is washed away by rain or by lawn irrigation. For that reason, some pesticide systems include an option for a user to invoke spray on-demand for increased effectiveness during high pest periods, and/or to re-apply the pesticide after rainfall or lawn irrigation. In addition, the application of pesticides in large quantities can be harmful to the environment.

Another approach is to surround an activity area with devices that attract and electrocute insects, in the hope that any approaching insects will be lured away and destroyed before they reach the outdoor activity area. However, this approach can backfire, in that the luring features of these devices can draw additional insects to the activity area, such that even though some insects are intercepted, a large number of others continue past the devices and enter the activity area.

With reference to FIG. 1A, another, somewhat more effective method for repelling insects from an outdoor activity area 100 is to locate one or more torches 102 in the area 100 that burn a liquid fuel that is mixed with a natural and non-toxic insect repellent, such as citronella. Often, the torches are supported on poles 106 that are simply inserted into the ground. Ironically, this approach can be least effective where it is most needed, which is in wet climates, because the ground can become too soft and water-saturated to support the torches, especially when rain is accompanied or followed by wind. As an alternative, the torches 102 can be permanently mounted, for example set into a cement slab, removably insertable into holes provided in an underlying hard surface, or supported by removable stands 104, which can be filled with sand or water to increase weight and stability.

As the fuel is burned in the torches 102, the repellent is continuously vaporized and disbursed throughout the activity area 100, thereby continuing to repel insects away from the area 100 for as long as the torches 102 continue to burn. Furthermore, if an activity takes place, or continues, after sunset, the light from the torches 102 can be an esthetically attractive feature. For these reasons, liquid fuel burning torches 102 are very frequently used to repel mosquitos, fireflies, insects, and other pests. In particular, such torches 102 are highly preferred for repelling mosquitos. Furthermore, due to the attractive ambience that is provided by liquid fuel burning torches, it can be desirable to place them around and/or throughout an outdoor activity area even if insect pests are not present. In such cases, it may not be necessary to add insect repellent to the liquid fuel.

With reference to FIGS. 1B and 1C, conventional liquid fuel burning torches 102 generally include a local fuel tank 108. In the example of FIG. 1B the fuel tank 108 is the entire interior of the torch 102, while the torch of FIG. 1C includes a separate fuel tank 108 within an outer shell 120. The torches 102 in FIGS. 1B and 1C further include a wick port 110 through which a wick 112 is inserted into fuel 116 contained within the fuel tank 108. The fuel tank 108 is filled with fuel 116 by pouring fuel 116 manually into the fuel tank 108 before the wick 112 is ignited. The torch of FIG. 1B includes a separate fuel port 114 for filling of the fuel tank, while the torch 102 of FIG. 1C is filled by temporarily removing the wick 112 and filling the tank 108 through the wick port 110. The torch 102 in FIG. 1B further includes a cylindrical cavity 118 into which a pole 106 can be inserted for support of the torch 102 above the ground, while the torch 102 of FIG. 1C is permanently welded to the top of the pole 106.

Liquid fuel burning torches 102 typically have small fuel reservoirs, which can become exhausted before an outdoor activity has ended. While such torches 102 can typically be refilled, most cannot be safely refilled while in use, nor can they be safely refilled after use until they have cooled to a temperature that is near ambient. Furthermore, the need to manually light, extinguish, and re-fill the torches places a stringent limit on their height, so as to enable users to perform these tasks without the help of a ladder. As a result, the torches are typically positioned at the height of an average user, which poses a danger to users of an outdoor activity area, who may inadvertently approach too close to a burning torch and be burned. This danger is significantly increased for activities that include the serving of alcoholic beverages. For these and other reasons, this approach is not practical when regular, repeated use of a plurality of torches is required.

As the use of liquid fuel burning torches continues to increase, not only by individuals but also by establishments such as hotels, restaurants, and resorts, it would be desirable for the torches to continue burning fuel over long periods of time. However, for larger establishments such as large restaurants, hotels, and travel resorts, it can be inconvenient and expensive to re-fill and/or exchange a large number of liquid fuel burning torches several times over the course of a day and evening, as they repeatedly exhaust their local fuel supplies.

Instead, a recently introduced approach according to U.S. Pat. No. 10,842,146, as well as co-pending U.S. patent applications Ser. Nos. 17/585,463, 17/138,322, 17/023,957, and 17/585,463 and international applications PCT/US20/62120 and PCT/US22/13950 (all of which are incorporated herein by reference in their entirety for all purposes), provides an automatic refueling system that can refuel any desired number of liquid fuel burning torches as needed by pumping liquid fuel from a central reservoir through a torch plumbing system to the torches. According to this approach, a large number of torches can continue burning almost indefinitely.

A controller can be included in the refueling system to provide automated torch re-filling as needed. The controller can include wireless remote access to enable remote monitoring and control of the torch system. In some implementations, as is taught in co-pending application Ser. No. 17/585,463, also by the present inventor, the torches include passive, automatic fuel overfill prevention valves, such that the refueling system is merely required to maintain a liquid fuel pressure within the torch plumbing system to ensure that the torches are automatically maintained at a desired fill level.

Some previously disclosed automatic torch refueling systems further include automated torch ignition. However, automated extinguishing of the torches can be problematic, while manually extinguish the torches can be inconvenient, and can limit the heights of the torches.

What is needed, therefore, is an automatic torch refueling system that can reliably extinguish an arbitrary number of fuel-burning torches under automated and/or remote control.

SUMMARY OF THE INVENTION

The present invention is an automatic torch refueling system that can refuel any desired number of interconnected, liquid fuel burning torches as needed by pumping liquid fuel from a central reservoir through a torch plumbing system and into the torches through fill pipes or hoses that are included in the torch plumbing system and through vertical standpipes that support the torches and provide liquid communication with the fuel tanks of the torches. The refueling system further includes a controller that controls a fuel pumping system and other controllable elements of the system. In embodiments, the controller automatically refills the torches as needed while they are in use. When the torches are no longer in use, the automatic torch refueling system of the present invention is able to reliably and automatically extinguish the torches by reversing the pumping direction of the fuel pumping system, and thereby withdrawing the liquid fuel from the torches.

In some embodiments, the standpipes provide unobstructed liquid access to the fuel tanks, such that reversing the pumping direction drains all of the fuel from the fuel tanks, or at least to a level that is below the wicks. As a result, the torches are extinguished as soon as the fuel that is retained by the wicks is exhausted.

In other embodiments, each of the torches includes a passive, automatic fuel overfill prevention (FOP) valve which ensures that the torch is automatically maintained at a desired fill level within its fuel tank so long as liquid fuel is maintained under pressure in the standpipe. In some of these embodiments, when the pumping direction is reversed, the liquid fuel is initially unable to drain from the fuel tank if the FOP valve is closed. Instead, the torch will continue to burn until the fuel level in the fuel tank has fallen sufficiently to cause the FOP valve to open, at which point the fuel will be pumped out of the fuel tank until it falls below the wick. In other of these embodiments, the FOP valve includes at least one check valve, located below the valve plug of the FOP valve, where the check valve is normally closed, but opens when the pressure in the standpipe exceeds the pressure in the fuel tank. When the pumping direction is reversed, these one or more check valves open, and allow the fuel to be pumped out of the fuel tank even if the FOP valve is closed.

The torch extinguishing mechanism of the present invention was enabled, in part, by a realization that locally implemented torch extinguishing systems, such as mechanically operated snuffer caps and wick constrictors that attempt to cut off the flow of fuel through the wick, can be difficult and expensive to implement. The present invention was further enabled by a realization that immediate extinguishing of a set of interconnected torches was not necessarily required. Accordingly, the torch extinguishing mechanism of the present invention does not attempt to extinguish torches instantaneously, but instead ensures that all of the interconnected torches will cease to burn within a relatively short time, in some embodiments within 10 minutes, in other cases up to an hour, after the pumping direction has been reversed.

In some embodiments, the controller provides wireless remote access, so that the torch refueling system can be monitored and/or controlled remotely, for example via a "smart" cellular telephone or similar portable, hand-held device.

In embodiments, the torch further includes a heat sensor that is in or proximal to the combustion area of the torch, and can be used to determine when the extinguishing process has been completed. Once the torch has been extinguished, embodiments proceed to partly or fully refuel the torch, so as to prevent the wick from becoming dry and brittle. In other embodiments, the internal fuel tank of the torch remains empty until shortly before the torch is reignited, so as to further reduce any possibility of fuel being spilled out of the torch when not in use.

In some embodiments, the fuel pumping system includes a single pump that is bi-directional, in that it is configured to pump liquids in either direction according to the direction of rotation of its impellor. This allows the controller to extinguish the torches simply by reversing the direction of rotation of the motor that drives the pump. Embodiments implement a pump driven by a direct current motor, such that the controller is able to reverse the pumping direction simply by reversing the polarity of the electrical voltage that is applied to the motor.

In other embodiments, the fuel pumping system includes a single pump and associated motor that are configured to always operate in the same rotational direction. In some of these embodiments, the torch extinguishing mechanism comprises one or more flow reversal valves that operate under control of the controller to reverse the pumping direction of the fuel within the torch plumbing system. When the valves are in their "forward" configurations, the pump operates to deliver fuel from the central reservoir to the torches. Upon activation of the torch extinguishing mechanism, the controller causes the valves to be reconfigured into their "reverse" configurations, whereby the pump operates to remove fuel from the torches and return it to the central reservoir.

In still other embodiments, the fuel pumping system includes two pumps, one of which is configured to always pump the liquid fuel in a forward direction from the central reservoir toward the torches, while the other pump is configured to always pump the liquid fuel in a reverse direction from the torches to the central reservoir. In some of these embodiments the fuel pumping system further includes at least one directional valve that can be actuated by the controller to connect either the forward pump or the reverse pump to the torch plumbing system.

In embodiments, the torches also include automatic ignitors that can be actuated by the controller, either automatically and/or under remote control, to ignite the torches. In these embodiments, the torches can be installed at any desired height above grade, since normal usage does not require physical access to the torch. Each wick ignitor can include electrical leads separated by a spark gap and configured to create a spark near the wick when electricity is supplied to when leads. The supplied electricity can create the spark directly, or a condenser can be pre-charged and then discharged when needed to create the igniting spark. Low voltage power for operating the automatic wick igniter can be provided by a transformer proximal to the pump at a relatively low voltage from an outdoor low voltage power supply that meets National Electrical Code (NEC) NFPA 70 for safe electrical design and installation, as is adopted in all 50 states of the United States. The low voltage power can be directed through a low voltage power line to the torches in parallel with pipes and/or trenches of the fuel plumbing system.

A first general aspect of the present invention is a liquid fuel burning torch system that includes automatic refueling of one or more torches and automatic extinguishing of the torches. The liquid fuel burning torch system includes a central fuel reservoir configured to contain a flammable liquid fuel, at least one torch, each of said torches having a substantially enclosed interior and a local fuel reservoir located within said interior, the local fuel reservoir being configured to contain a local quantity of said liquid fuel, each of said torches further comprising a combustion area exterior to the torch and configured for burning said liquid fuel when drawn by a wick from said local quantity into said combustion area, and a torch refueling system.

The torch refueling system includes a torch plumbing system that provides liquid communication between the central fuel reservoir and the standpipes, thereby providing liquid communication between the central fuel reservoir and the local fuel reservoirs of said torches, a plurality of standpipes in liquid communication with the torch plumbing system and with the torches, each of said torches being supported by one of the vertical standpipes, a fuel pumping system comprising at least one pump, and a controller that is configured, when the torches are in use, to maintain fuel within the local fuel reservoirs of the torches by causing the fuel pumping system to pump the fuel in a forward flow direction from the central reservoir through the torch plumbing system and the standpipes to the local fuel reservoirs of each of the torches, the torches, while interconnected with each other by the torch plumbing system and standpipes, being otherwise structurally independent and separate from each other and from the central reservoir.

The controller is further able to extinguish the torches by causing the fuel pumping system to reverse the flow direction of the fuel in the torch plumbing system and standpipes, so that the fuel is pumped from the local fuel reservoirs of the torches through the standpipes and the torch plumbing system to the central fuel reservoir, thereby at least partially emptying the local fuel reservoirs of the torches.

In embodiments, the fuel pumping system includes only one pump, and the controller is able to reverse the flow direction of the fuel in the torch plumbing system and standpipes by reversing a pumping direction of the pump.

Or the fuel pumping system can include only one pump that is configured to only operate in a forward pumping direction, the liquid fuel burning torch system can further include a plurality of flow reversal valves configured, when actuated, to connect an input of the pump to the torch plumbing system while connecting an output of the pump to the central reservoir, and the controller can be able to reverse the flow direction of the fuel in the torch plumbing system and standpipes by actuating the flow reversal valves.

Or the fuel pumping system includes a first pump that is configured to only operate in the forward pumping direction and a second pump that is configured to only operate in a reverse pumping direction, and causing the fuel pumping system to reverse the flow direction of the fuel in the torch plumbing system and standpipes includes redirecting the fuel so that it flows through the second pump instead of through the first pump.

In any of the above embodiments, the controller can include wireless access that enables at least one of remote monitoring and remote control of the liquid fuel burning torch system. In some of these embodiments the liquid fuel burning torch system can be remotely monitored and/or controlled via a software application that operates on a hand-held electronic device.

In any of the above embodiments, at least one of the torches can further comprise a torch igniting system that is configured to ignite the torch under control of the controller.

In any of the above embodiments, at least one of the torches can further comprise a heat sensor located in or proximal to the combustion area, the heat sensor being in electronic communication with the controller, thereby enabling the controller to determine whether the torch has been extinguished.

In any of the above embodiments, at least one of the torches can includes a fuel overfill prevention (FOP) valve having a FOP valve plug within an internal passage that is lifted toward a seat by a float when a fuel level within the local fuel reservoir rises above the float, thereby closing the FOP valve when the float reaches a maximum fuel level and the plug is sealed against the seat; the FOP valve, when open, being configured to allow the liquid fuel to flow from the standpipe through the internal passage of the FOP valve, through a fill port of the FOP valve, and into the local fuel reservoir; the FOP valve, when closed, being configured to prevent the liquid fuel from flowing into the local fuel reservoir from the standpipe. In some of these embodiments the internal passage of the FOP valve is configured to direct a flow of the liquid through a flow path to the fill port without the flow path directly impinging on the FOP valve plug. Any of these embodiments can further include a check valve that is located below the seat of the FOP valve and is configured to remain closed when a pressure of the liquid fuel in the local fuel reservoir is less than or equal to a pressure of the liquid fuel within the standpipe, and to automatically open and allow the liquid fuel to flow from the local fuel reservoir into the standpipe when the FOP valve is closed and a pressure of the liquid fuel in the local fuel reservoir is greater than a pressure of the liquid fuel within the standpipe by more than a threshold pressure difference.

A second general aspect of the present invention is a method of igniting, maintaining, and extinguishing a torch included in a liquid fuel burning torch system. The method includes providing a liquid fuel burning torch system according to the first general aspect, for at least one of the torches included in the liquid fuel burning torch system causing the fuel pumping system to pump the liquid fuel in a forward flow direction from the central reservoir through the torch plumbing system and the standpipes to the local fuel reservoir of the torch, igniting the torch, during a torch usage period, causing the fuel pumping system to pump the liquid fuel in the forward flow direction through the torch plumbing system and standpipes, thereby refilling the local fuel reservoir of the torch, as needed, to maintain communication between the wick and the liquid fuel within the local fuel reservoir of the torch, and upon termination of the torch usage period, causing the fuel pumping system to pump the liquid fuel in a reverse flow direction through the torch plumbing system and standpipes, thereby at least partially emptying the liquid fuel from the local fuel reservoir of the torch, so that the wick is isolated from direct contact with the liquid fuel in the local fuel reservoir, and thereby causing the torch to be extinguished once any liquid fuel remaining in the wick has been consumed.

In embodiments, the fuel pumping system includes only one pump, and the step of causing the fuel pumping system to pump the liquid fuel in the reverse flow direction includes reversing a pumping direction of the pump.

In other embodiments, the fuel pumping system includes only one pump in liquid communication with a plurality of flow reversal valves, and wherein the step of causing the fuel pumping system to pump the liquid fuel in the reverse flow direction includes actuating the flow reversal valves so as to connect an input of the pump to the torch plumbing system while connecting an output of the pump to the central reservoir.

In still other embodiments, the fuel pumping system includes a first pump that is configured to only operate in the forward pumping direction, and a second pump that is configured to only operate in a reverse pumping direction, and wherein the step of causing the fuel pumping system to pump the liquid fuel in the reverse flow direction includes redirecting the fuel so that it flows through the second pump instead of through the first pump.

In any of the above embodiments, the torch can further comprise a torch igniting system that is configured to ignite the torch under control of the controller, and the step of igniting the torch can include the controller causing the torch igniting system to ignite the torch.

In any of the above embodiments, the torch can further comprise a heat sensor located in or proximal to the combustion area, the heat sensor being in electronic communication with the controller, and the method can further include the controller determining when the torch has been extinguished according to information received by the controller from the heat sensor. Some of these embodiments further include, once the controller has determined that the torch has been extinguished, the controller causing the fuel pumping system to pump the liquid fuel in the forward flow direction through the torch plumbing system, thereby at least partially re-filling the internal fuel reservoir of the torch.

In any of the above embodiments, the torch can include a fuel overfill prevention (FOP) valve having a FOP valve plug within an internal passage that is lifted toward a seat by a float when a fuel level within the local fuel reservoir rises above the float, thereby closing the FOP valve when the float reaches a maximum fuel level and the plug is sealed against the seat, the FOP valve, when open, being configured to allow the liquid fuel to flow from the standpipe through the internal passage of the FOP valve, through a fill port of the FOP valve, and into the local fuel reservoir, the FOP valve, when closed, being configured to prevent the liquid fuel from flowing into the local fuel reservoir from the standpipe. In some of these embodiments the internal passage of the FOP valve is configured to direct a flow of the liquid fuel through a flow path to the fill port without the flow path directly impinging on the FOP valve plug. And in any of these embodiments the FOP valve can further include a check valve that is located below the seat and is configured to remain closed when a pressure of the liquid fuel in the local fuel reservoir is less than or equal to a pressure of the liquid fuel within the standpipe, and to automatically open and allow the liquid fuel to flow from the local fuel reservoir into the standpipe when the FOP valve is closed and a pressure of the liquid fuel in the local fuel reservoir is greater than a pressure of the liquid fuel within the standpipe by more than a threshold pressure difference.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
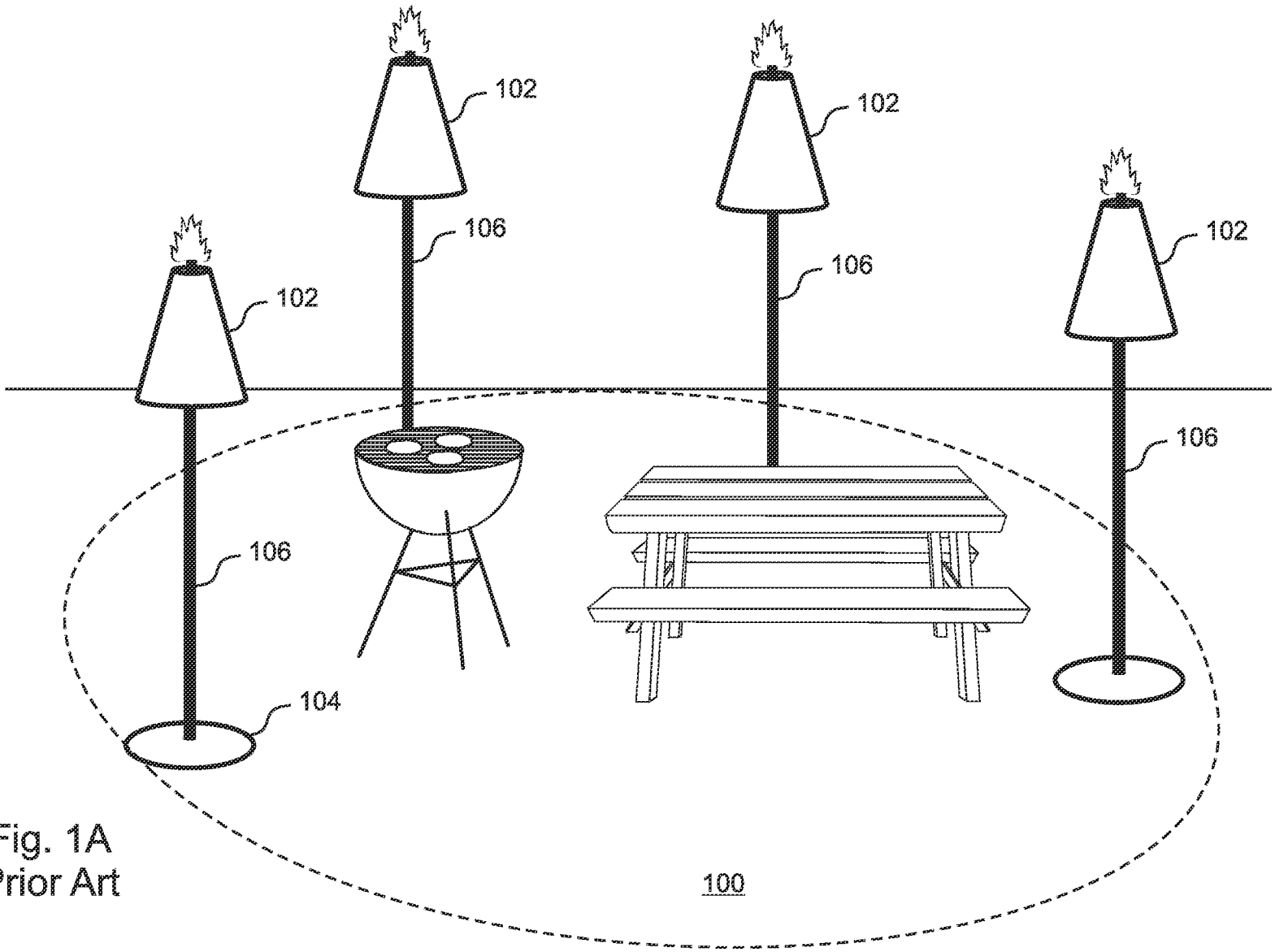
Fig. 1A Prior Art
FIG. 1A illustrates use in the prior art of torches that burn a fuel mixed with an insect repellent to exclude insect pests from an outdoor activity area, where the torches are self-contained and cannot be refilled with fuel while burning or while hot from recent use.
Figure 1B:
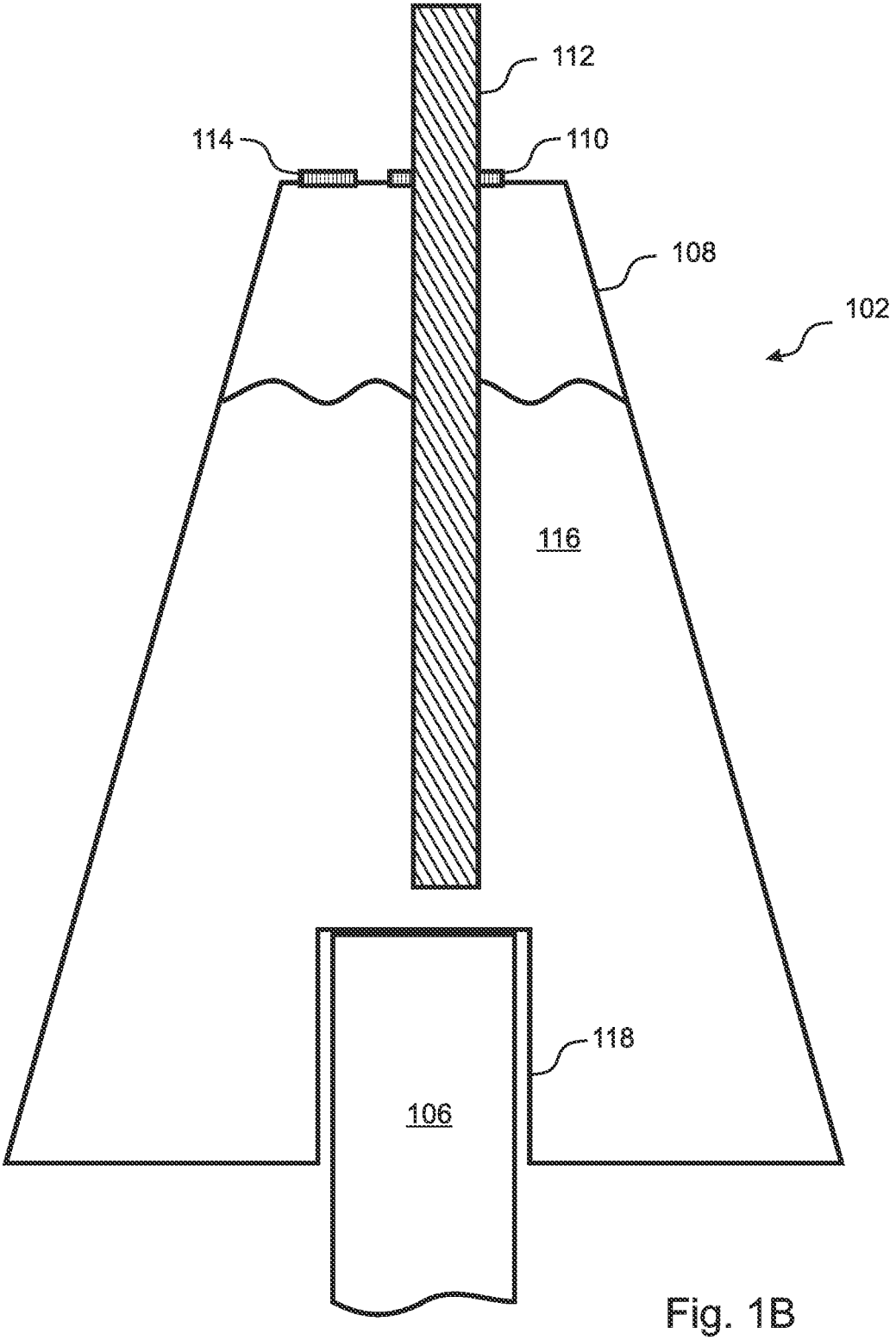
Fig. 1B (Prior Art)
FIG. 1B is a cross-sectional view of a representative insect repelling torch of the prior art for which the shell of the torch functions as the fuel tank.
Figure 1C:
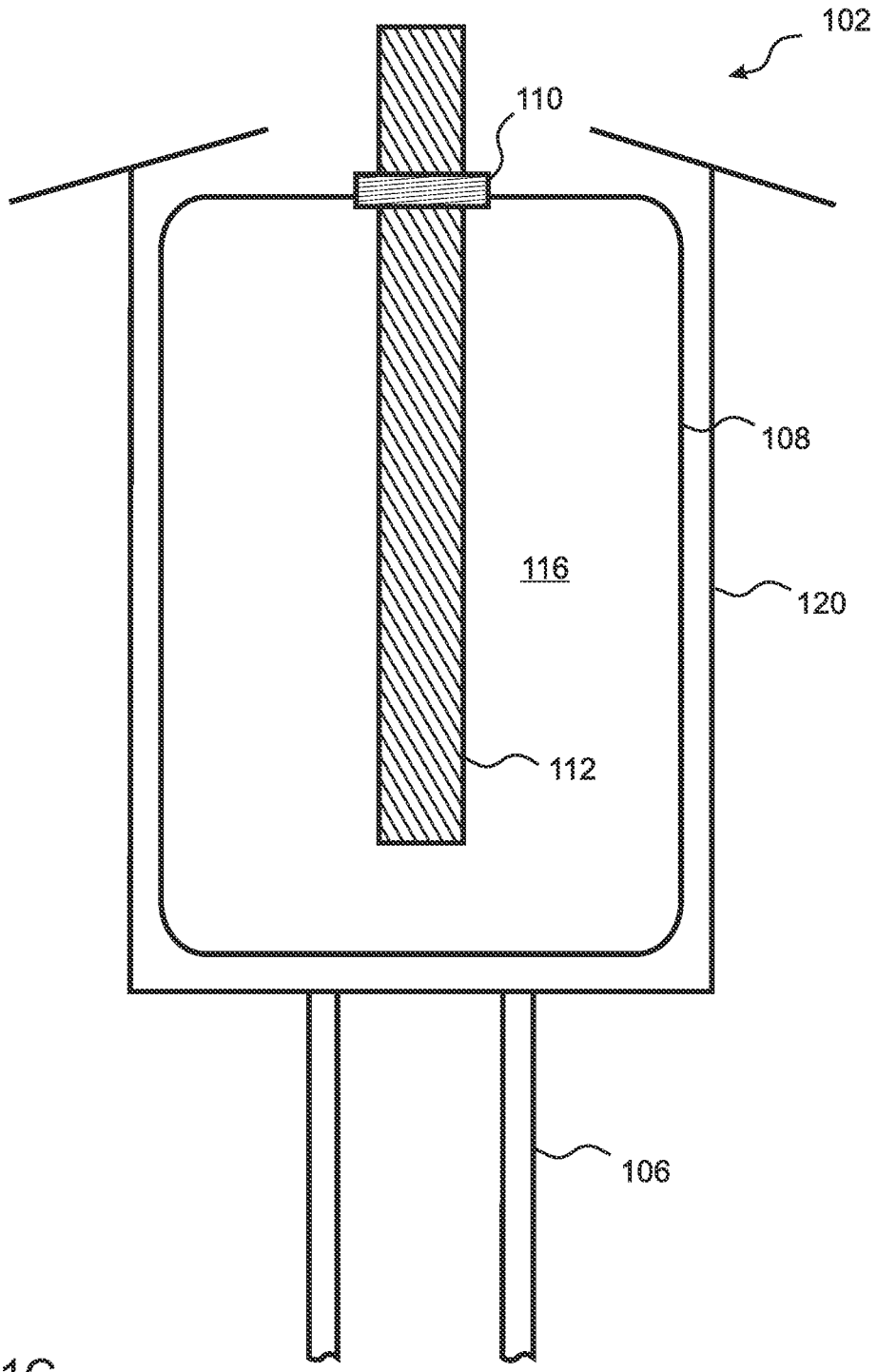
Fig. 1C (Prior Art)
FIG. 1C is a cross-sectional view of another representative insect repelling torch of the prior art that includes a separate fuel tank within an outer shell.
Figure 2A:
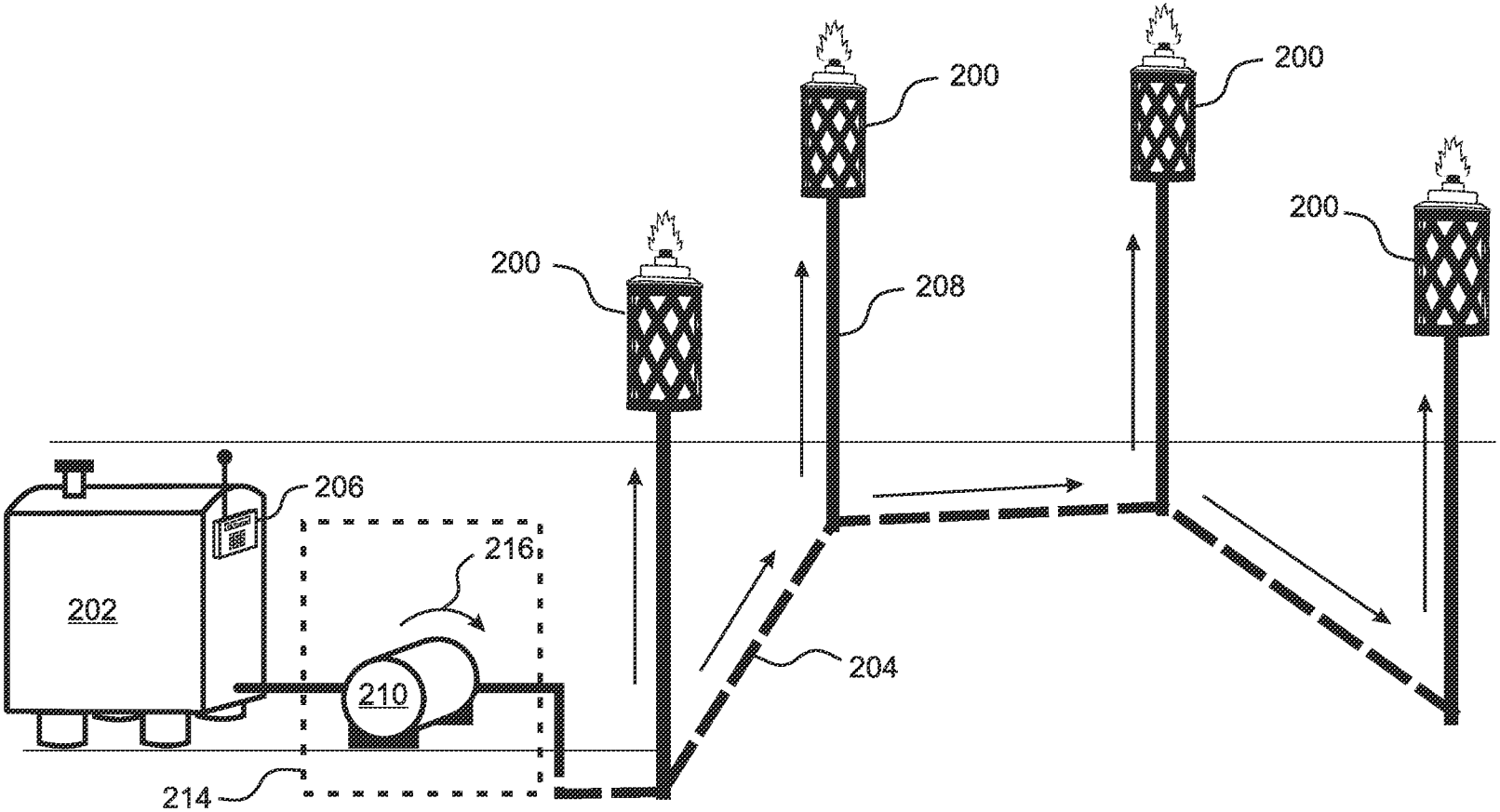
FIG. 2A is a perspective view of a torch system of the present invention wherein the fuel pumping system includes a single pump having a pumping direction that is reversable, shown with the pump operating in a forward direction and the torches supplied with fuel and lit.
Figure 2B:
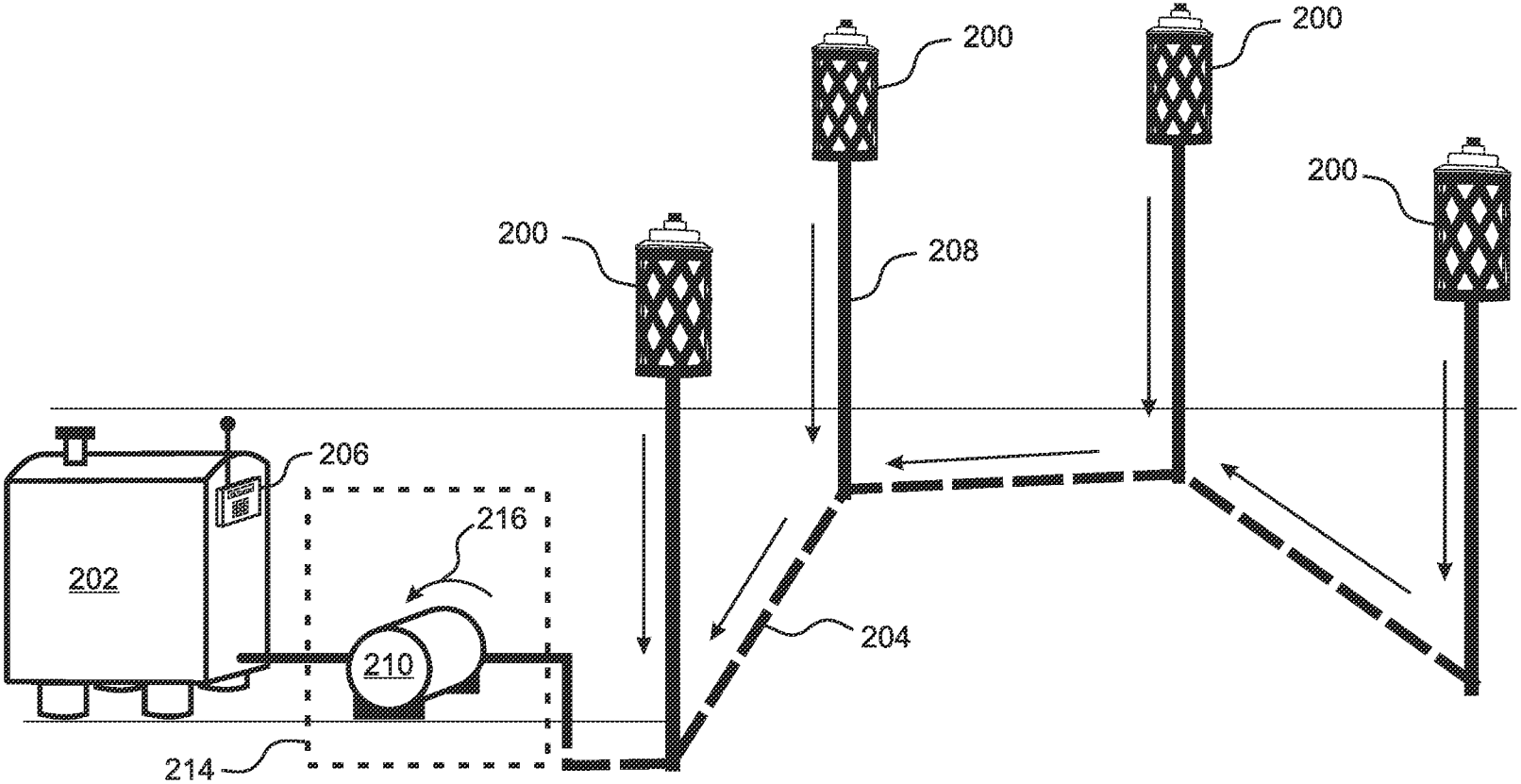
FIG. 2B is a perspective view of the torch system of FIG. 2A shown with the pump operating in a reverse direction and the torches extinguished due to lack of fuel.

With reference to FIGS. 2A and 2B, the present invention is an automatic torch refueling system that can refuel an arbitrary number of interconnected, liquid fuel burning torches 200, as needed, by causing a fuel pumping system 214 to pump liquid fuel from a central reservoir 202 through the pipes or hoses of a torch plumbing system 204, and through hollow standpipes 208 that support the torches. As a result, with reference to FIG. 2A, the torches 200 can continue to burn almost indefinitely. In the embodiment of FIGS. 2A and 2B, the fuel pumping system 214 includes only a single pump 210.

The refueling system further includes a controller 206 that controls the fuel pumping system 214 and other controllable elements of the system. In the illustrated embodiment, when the torches 200 are in use, as shown in FIG. 2A, the controller 206 automatically causes them to be refilled as needed. In the embodiment of FIGS. 2A and 2B, the controller 206 can be accessed remotely via wireless communication, so that the status of the torch refueling system can be monitored and/or controlled remotely, for example via a "smart" cellular telephone or similar portable, handheld device.

With reference to FIG. 2B, when the torches 200 are no longer in use, the automatic torch refueling system of the present invention is further able to reliably extinguish the torches 200 under automated and/or remote control by reversing the direction of flow in the torch plumbing system 204, thereby pumping most or all of the fuel from the torches 200 and returning the fuel to the central reservoir 202, so that the torches 200 are extinguished as soon as any residual fuel in their wicks 112 has been exhausted. This approach enables the torches 200 to be extinguished, while requiring that few if any special extinguishing elements or features are included in the torches 200.

In the embodiment of FIGS. 2A and 2B, the pump 210 is bi-directional, in that it is configured to pump liquids in either direction according to the direction of rotation of its impellor. The pump 210 is driven by a direct current motor (not separately shown), such that the controller 206 is able to reverse the rotational direction 216 of the pump 210 simply by reversing the polarity of the electrical voltage that is applied to the motor. Accordingly, the controller is able to extinguish the torches simply by reversing the direction of rotation of the motor that drives the pump.

Figure 3A:
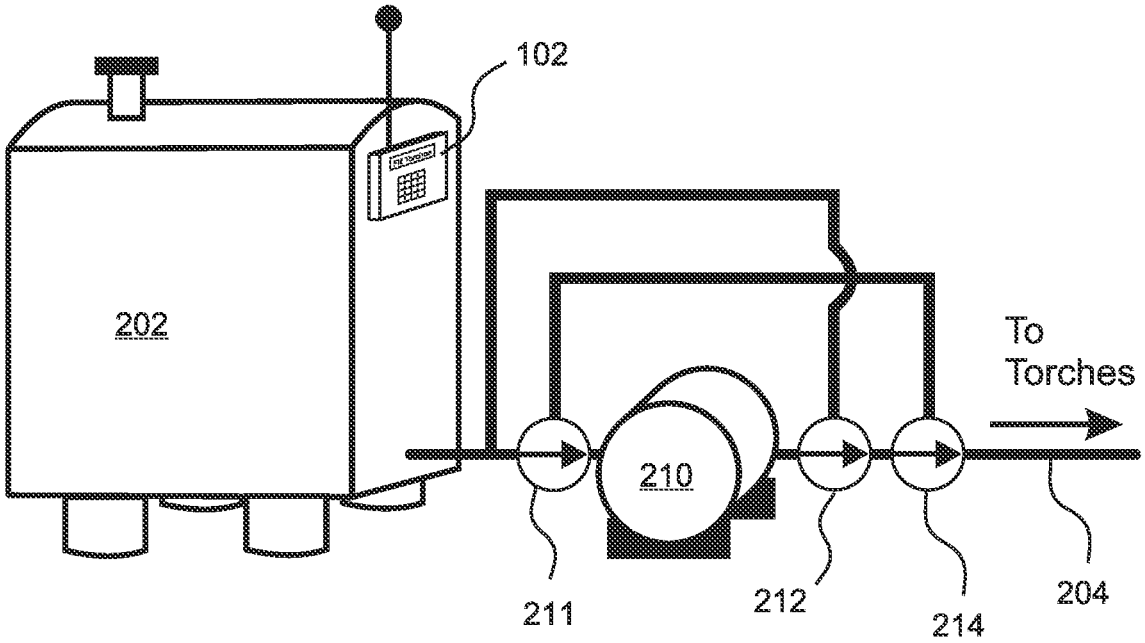
FIG. 3A is a perspective view of a torch system of the present invention in which the fuel pumping system includes only a single pump that is only able to pump liquid fuel in a single direction, and wherein the pumping direction of the fuel pumping system is reversed by a plurality of flow reversal valves, the flow reversal valves being shown in their forward configuration.
Figure 3B:
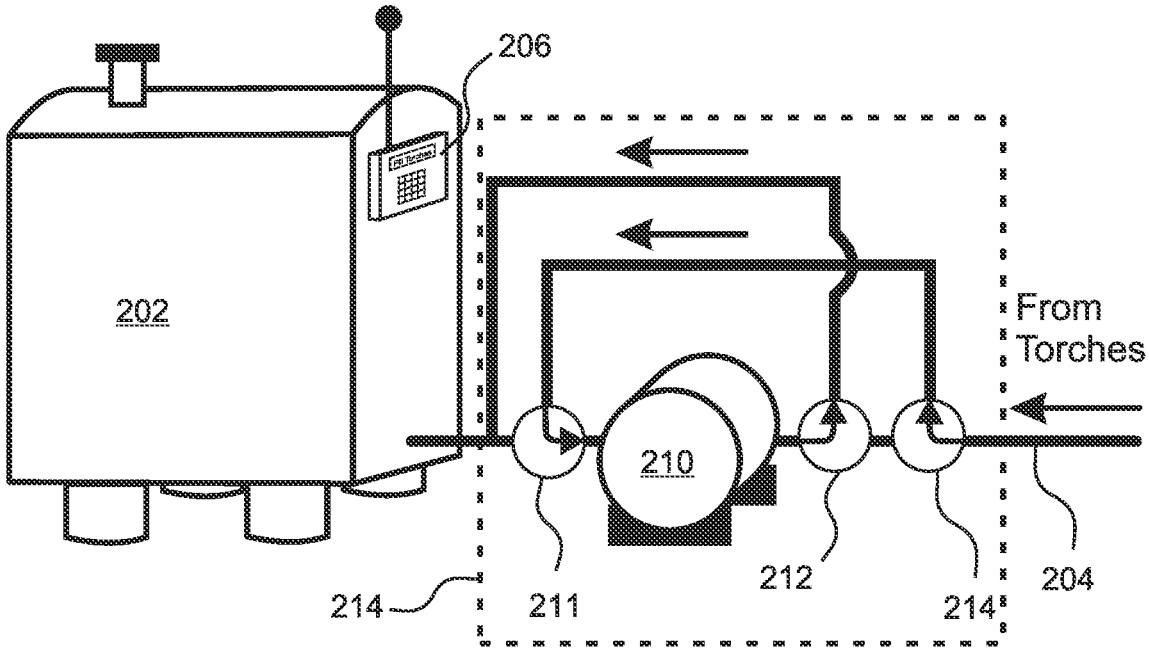
FIG. 3B is a perspective view of the torch system of FIG. 3A with the flow reversal valves being shown in their reverse configuration.

In the embodiment of FIGS. 3A through 4B, the fuel pumping system 214 includes a single pump 210 and associated motor that are configured to always operate in the same rotational direction. In the illustrated embodiment, the fuel pumping system 214 further comprises a plurality of flow reversal valves 211, 212, 214 that operate under control of the controller 206 to reverse the pumped direction of the fuel within the torch plumbing system 204. When the valves are in their "forward" configurations, as shown in FIG. 3A, the pump 210 operates to deliver fuel from the central reservoir 202 to the torches 200. Upon activation of the torch extinguishing mechanism, the controller 206 causes the flow reversal valves 211, 212, 214 to be reconfigured into their "reverse" configurations, whereby the pump 210 operates to remove fuel from the torches 200 and return it to the central reservoir 202.

Once the liquid fuel is removed from the local fuel reservoirs 116 of the torches 200, they continue to burn for only a brief time, until the residual fuel in their wicks 112 is exhausted, after which the torches 200 are extinguished.

Figure 4A:
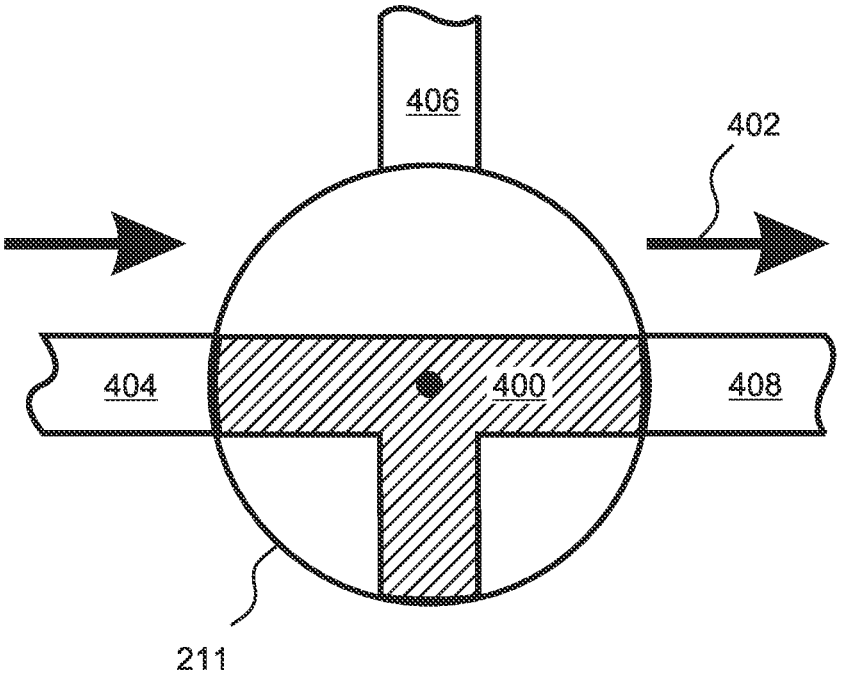
FIG. 4A is a simplified cross-sectional view of a flow reversal Y valve shown in a first configuration.
Figure 4B:
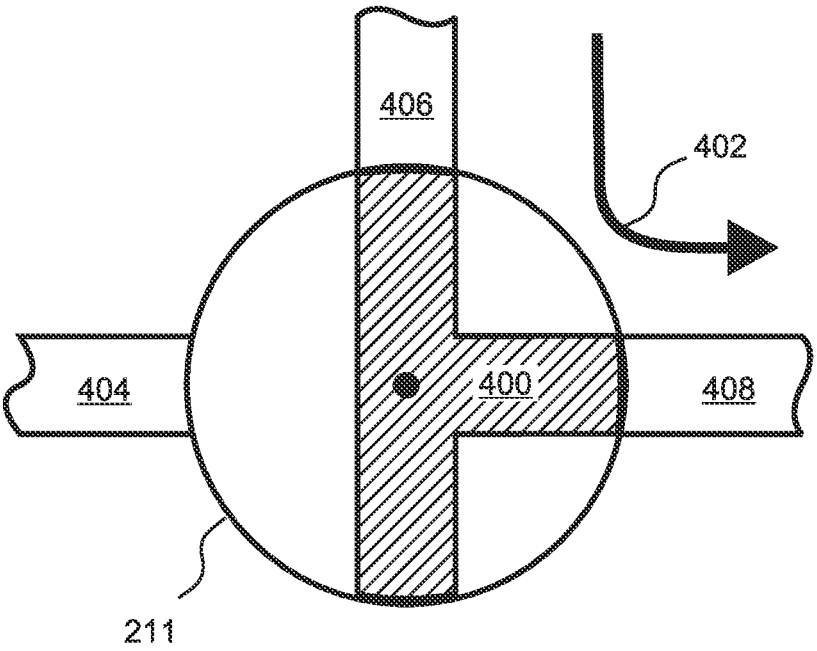
FIG. 4B is a simplified cross-sectional view of the flow reversal Y valve of FIG. 4A shown in a second configuration.

FIGS. 4A and 4B present simplified examples of valves that are used in embodiments as the flow reversal valves 211, 212, 214. The illustrated valve includes three access ports 404, 406, 408 and a central element 400 that can be rotated by a stepper motor under control of the controller 206 between the orientation shown in FIG. 4A and the orientation shown in FIG. 4B, thereby changing the flow direction 402 through the valve. In FIG. 4A, the two "side" access ports 404, 408 are interconnected, while the "top" access port 406 is disconnected. In FIG. 4B, the central element 400 has been rotated so as to disconnect the "left" access port 404, while interconnecting the top access port 406 with the right access port 408. One of skill in the art will realize immediately that many other valve designs can be implemented as the flow reversal valves 211, 212, 214.

With reference to FIGS. 5A-5E, embodiments of the present invention further include an FOP valve 518, which can extend from or be inserted partially or fully within an upper portion of the standpipe 208. In the illustrated embodiment, the FOP valve 518 includes a float 500 that is lifted by the liquid fuel 512 as the fuel reservoir 116 is filled, and a seat 502 that is sealed by a plug 504 when the float 500 has risen by a certain amount. A flow 524 of the liquid fuel 512 enters the torch fuel tank through the fill hole 514, and some of the fuel flows back through the upper hole 516 so that the valve is filled with fuel above the seat 502, and the float 500 is lifted by the fuel 512.

In the illustrated embodiment, the float 500 and plug 504 are separate components that are interlinked by a wire or rod 506, so that the plug 502 is caused to rise when the float 500 is lifted up by the liquid fuel 512. The illustrated embodiment further comprises an O-ring 508 located within a tapered internal passage 510 of the seat 502, such that the liquid fuel 512 flows into the fuel reservoir 116, as shown in FIG. 5B, until the plug 504 is lifted sufficiently to be pressed into the O-ring 508, at which point the flow of liquid fuel 512 into the fuel reservoir 116 is blocked, as is illustrated in FIG. 5C.

Figure 5A:
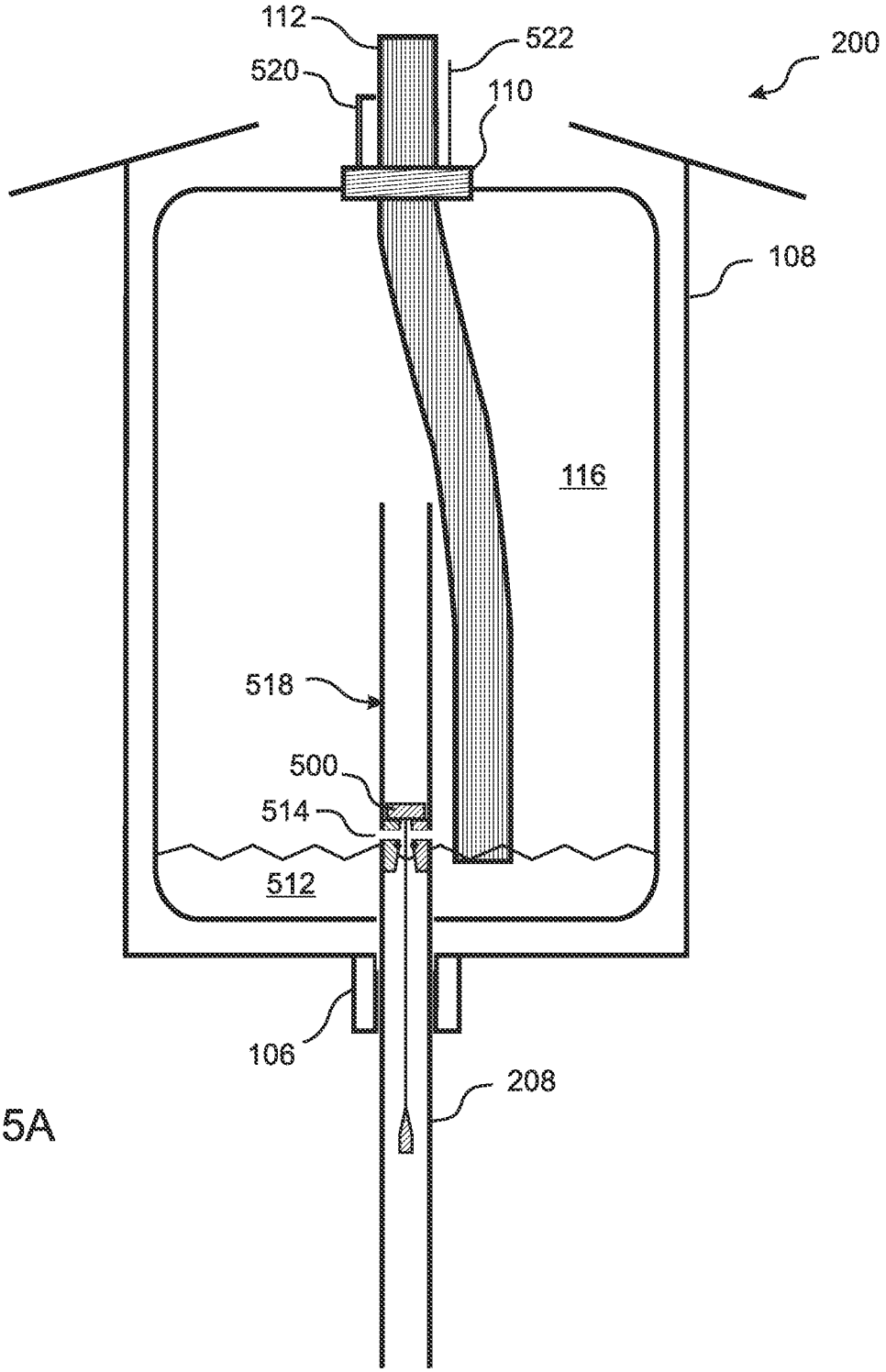
FIG. 5A is a cross sectional illustration of a fuel-burning torch having a fill pipe and fuel overfill prevention (FOP) valve, shown during initial filling thereof of fuel, according to an embodiment of the present invention installed therein.
Figure 5B:
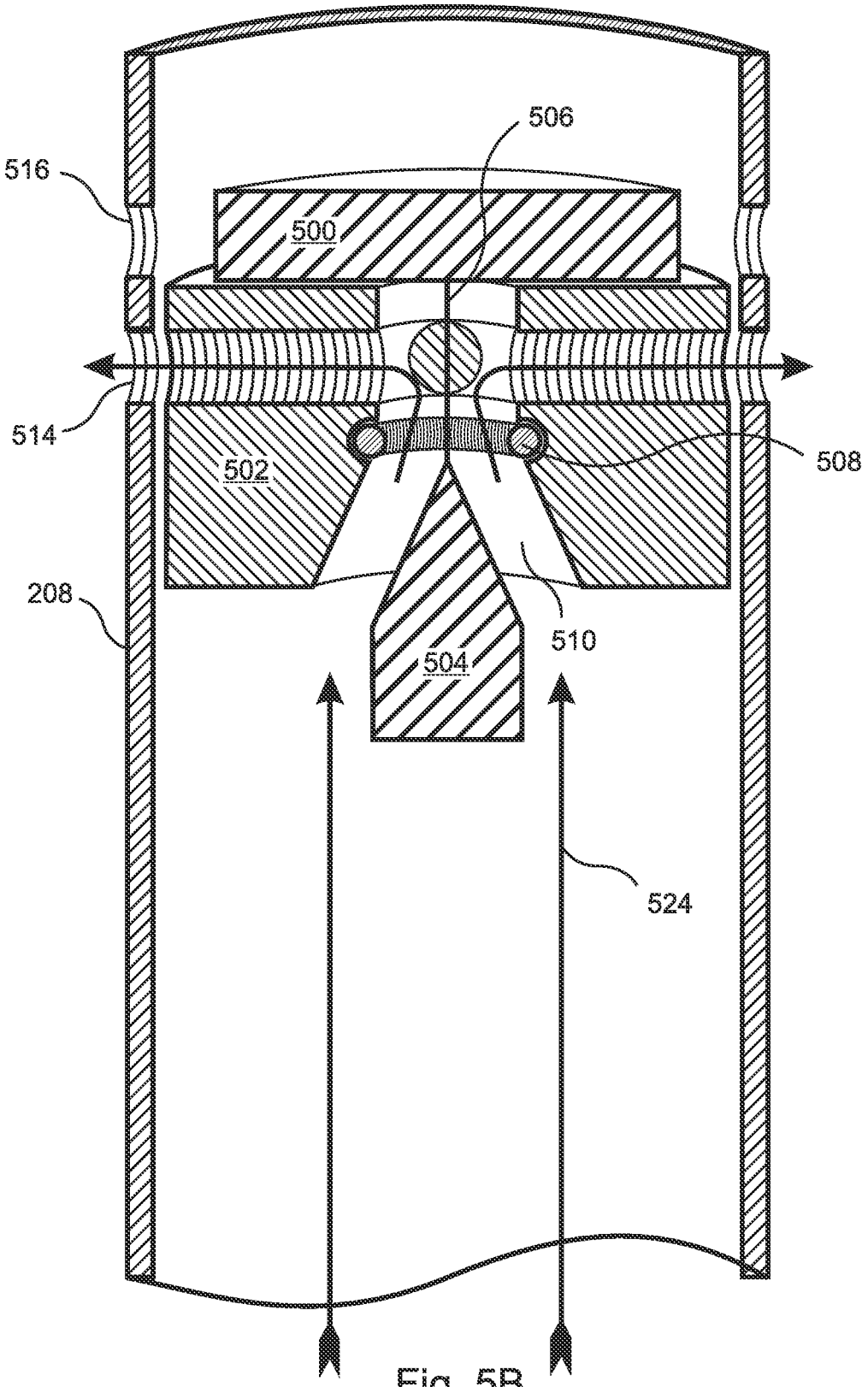
FIG. 5B is a sectional view of the standpipe and FOP valve similar to FIG. 5A but having a shorter interlinking wire or rod, shown in an open state.
Figure 5C:
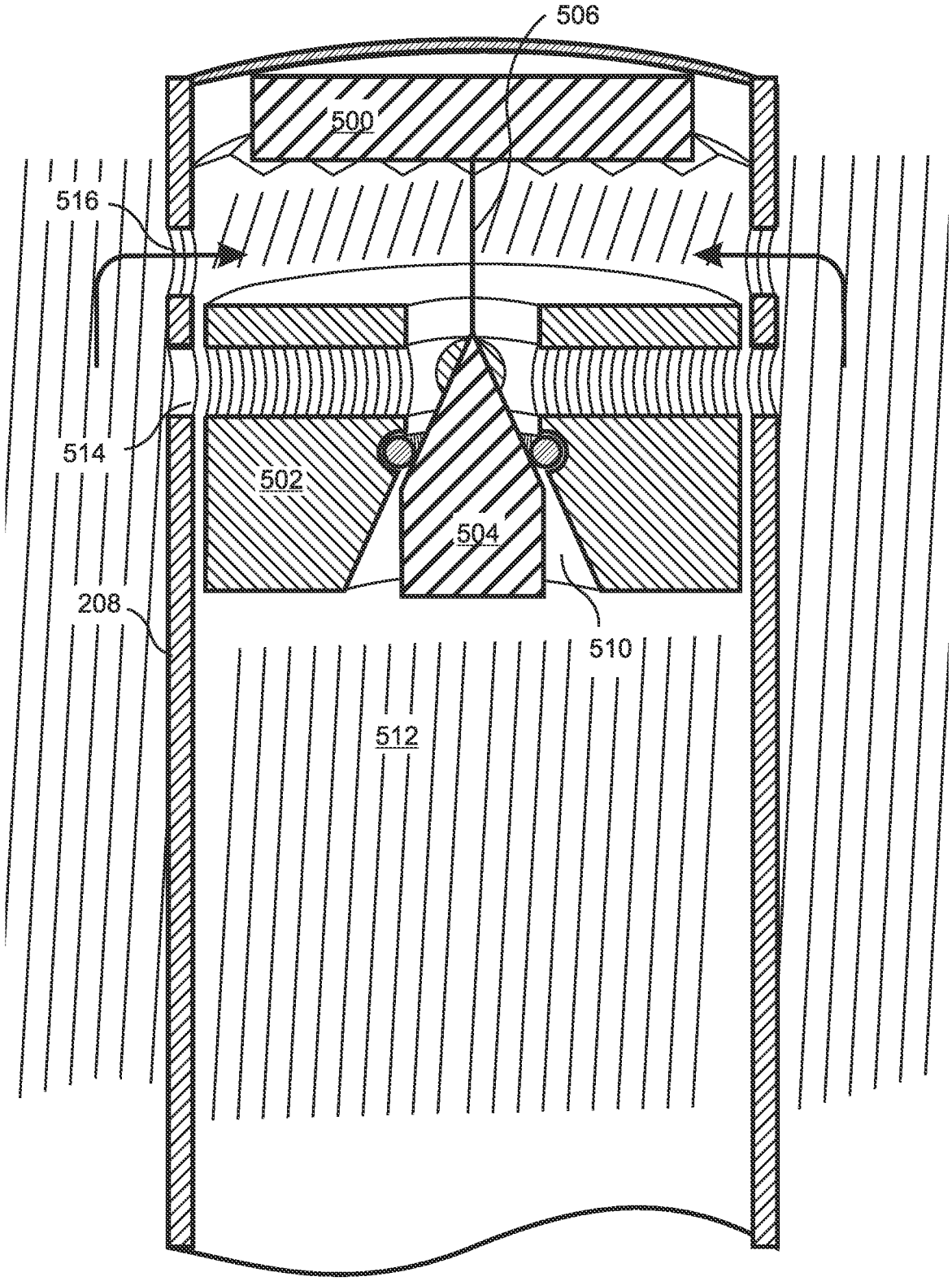
FIG. 5C is a sectional view of the standpipe and FOP valve of FIG. 5B, shown in a closed state.
Figure 5D:
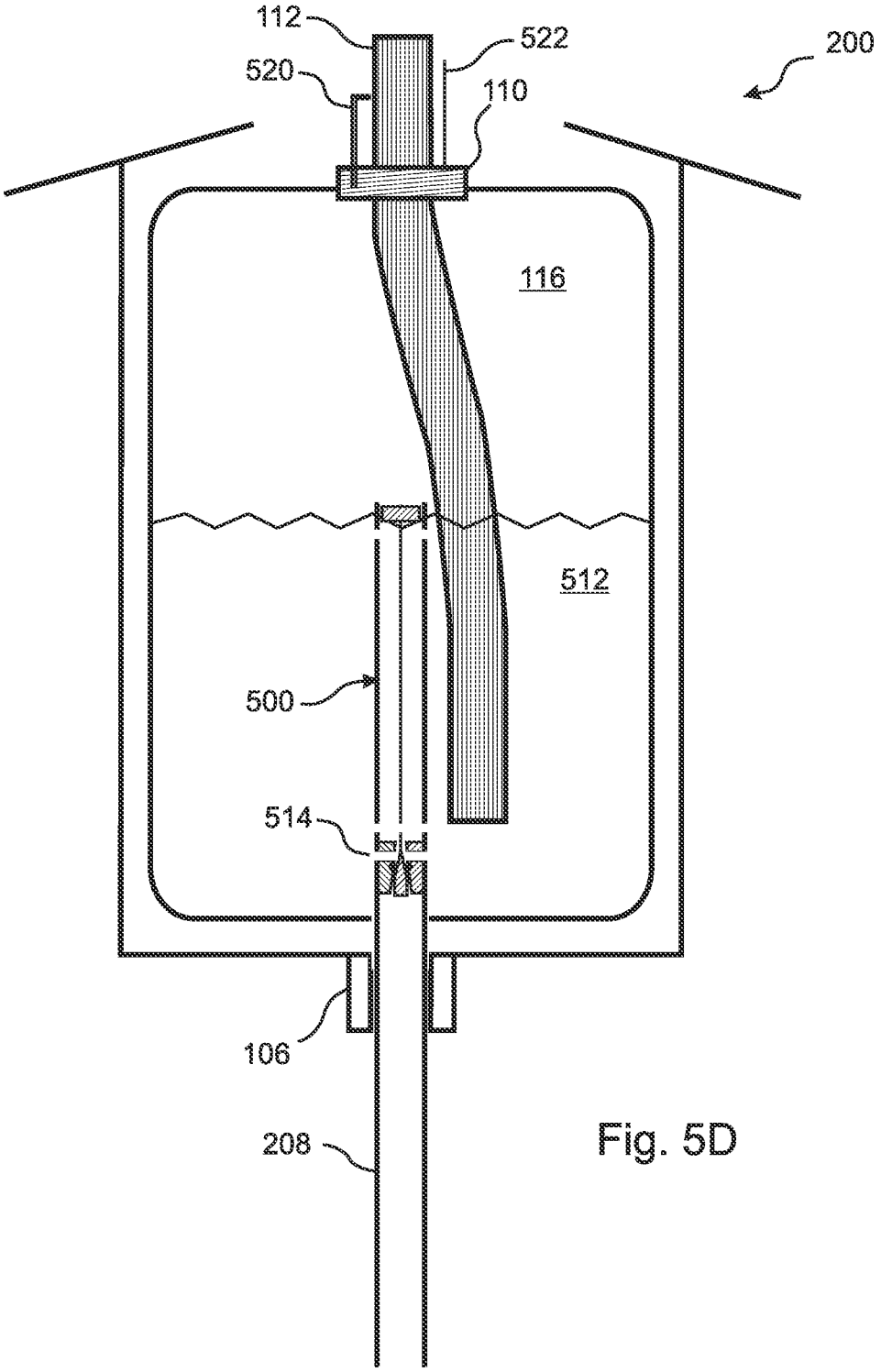
FIG. 5D is a cross sectional illustration similar to FIG. 5A, but shown with the fuel reservoir filled with fuel up to the maximum level that is permitted by the FOP valve.

As is illustrated in FIG. 5D, torches 200 that include an FOP valve 518 can only be filled until the level of the liquid fuel 512 in the local fuel reservoir 116 reaches a fill limit, at which point the FOP valve 518 is closed and prevents further filling. If the FOP valve in a torch 200 is closed when the extinguishing mechanism is activated, as illustrated in FIG. 5D, the local fuel reservoir 116 of the torch 200 will initially retain its fuel content. However, as soon as the fuel level within the local reservoir 116 drops even slightly below the fill limit, due to the continued burning of the torch and consequent consumption of the fuel, the FOP valve will open, as shown in FIG. 5E, and will allow the remaining fuel to be pumped out of the local fuel reservoir 116.

Figure 5E:
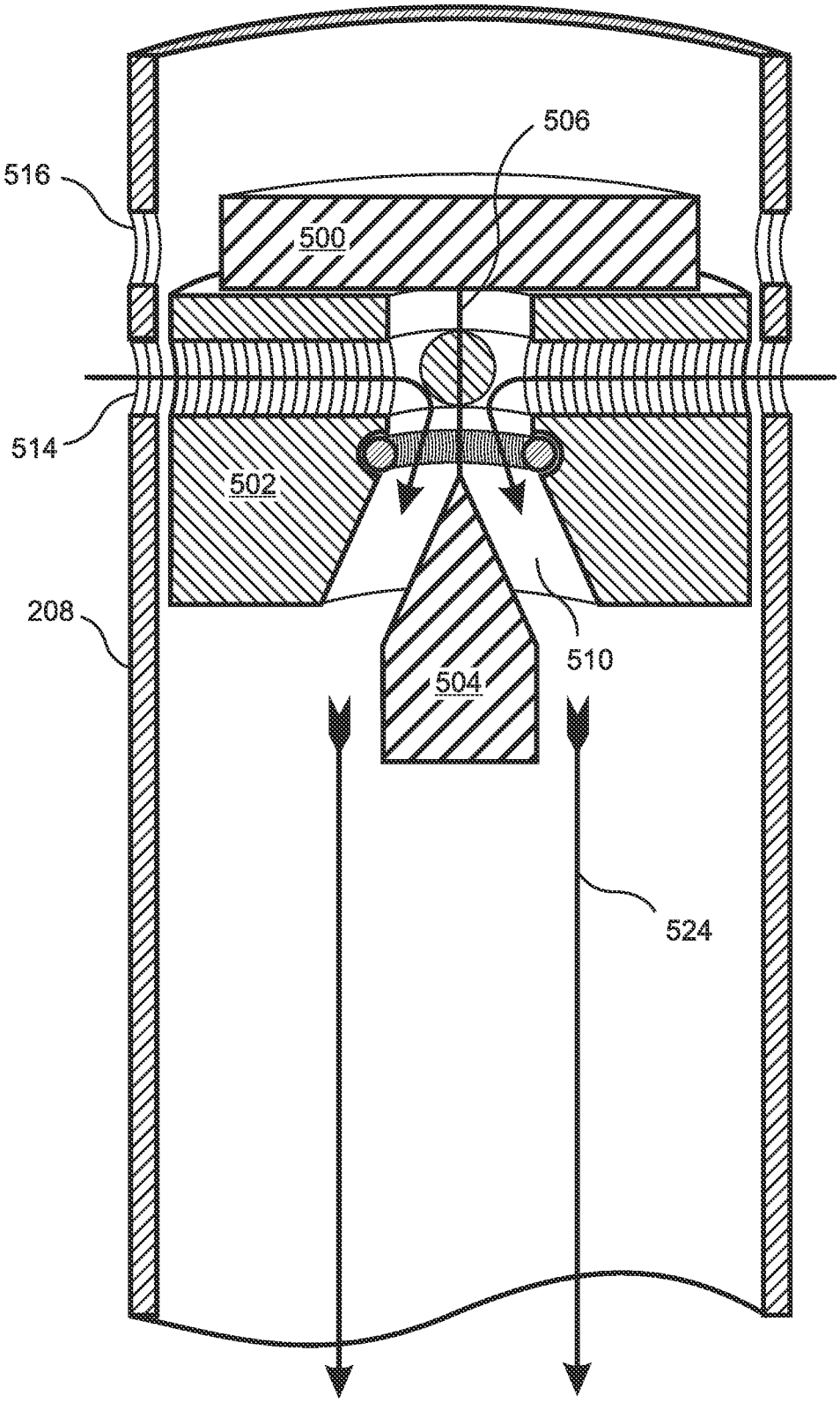
FIG. 5E is a cross sectional illustration similar to FIG. 5B, showing fuel being drained from the fuel reservoir through the FOP valve once sufficient fuel has been consumed to cause the FOP valve to re-open.

Note that in the embodiment of FIG. 5E, when the valve 518 is opened, the fuel can only be drained to the level of the lowest fill hole 514. In the illustrated embodiment, the wick is configured such that it does not extend below the lowest fill hole 514. In some embodiments the seat 502 and plug 504 are located in the standpipe 208 below the bottom of the local fuel reservoir 116, which allows the lowest fill hole 514 to be positioned at or below the bottom of the internal fuel reservoir 116.

As is shown in FIGS. 5A and 5D, the illustrated embodiment further includes an automatic wick ignitor 520 that can be remotely actuated by the controller 206, either automatically and/or under remote control, to ignite the torches 200. The wick ignitor 520 can include electrical leads separated by a spark gap and configured to create a spark near the wick when electricity is supplied to when leads. The supplied electricity can create the spark directly, or a condenser (not shown) can be included which is pre-charged with a high electric voltage and then discharged when needed to create the spark.

Figure 2C:
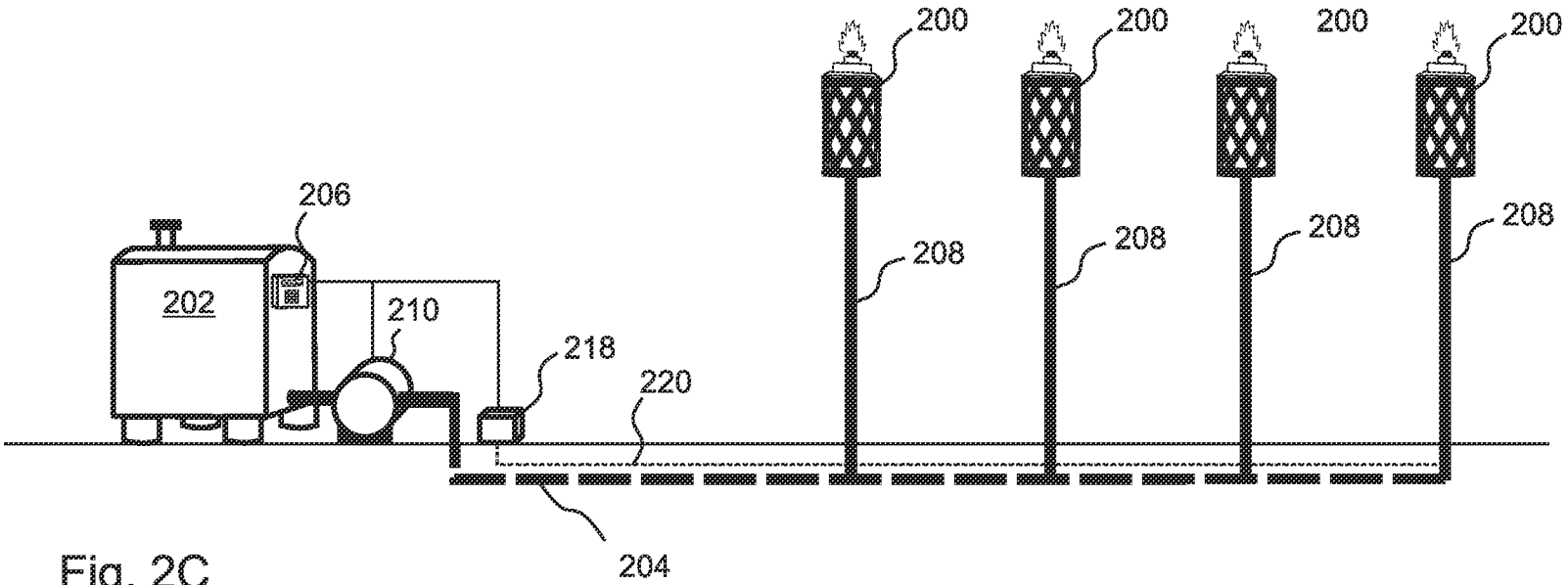
FIG. 2C is a side view of an embodiment of the present invention that includes a transformer and low voltage power line that supply electrical power to the torches.

With reference again to FIG. 2C, low voltage power for operating the automatic wick igniter 520 can be provided by a transformer 218 proximal to the pump 210 at a relatively low voltage from an outdoor low voltage power supply that meets National Electrical Code (NEC) NFPA 70 for safe electrical design and installation, as is adopted in all 50 states of the United States. The low voltage power can be directed through a low voltage power line 220 to the torches 200 in parallel with pipes and/or trenches of the fuel plumbing system 204. Electrical communication wiring (not shown) can be included in lieu of or in parallel with the low voltage power line 220 for communication of commands from the controller 206 to devices at the torches 200 and of sensed information from the torches 200 to the controller 206.

Accordingly, the controller 206 in these embodiments is able to automatically ignite, maintain, and then extinguish an arbitrary number of liquid fuel burning torches 200 according to a pre-programmed timing sequence and/or in response to locally or remotely entered commands. Also, in these embodiments the torches 200 can be installed at any desired height above grade, since normal usage does not require direct physical access to the torches 200.

In addition, as shown in FIGS. 5A and 5D, the illustrated embodiment further includes a wick heat sensor 522 in communication with the controller 206 via wired or wireless communication, which enables the controller 206 to sense when the extinguishing process has been completed. Once the torch 200 has been extinguished, embodiments proceed to partly or fully refill the internal fuel reservoir 116 with fuel, so as to prevent the wick 112 from becoming dry and brittle. In other embodiments, the internal fuel reservoir 116 of the torch 200 remains empty until shortly before it is reignited, so as to further reduce any possibility of fuel being spilled out of the torch 200 when it is not in use.

Figure 6A:
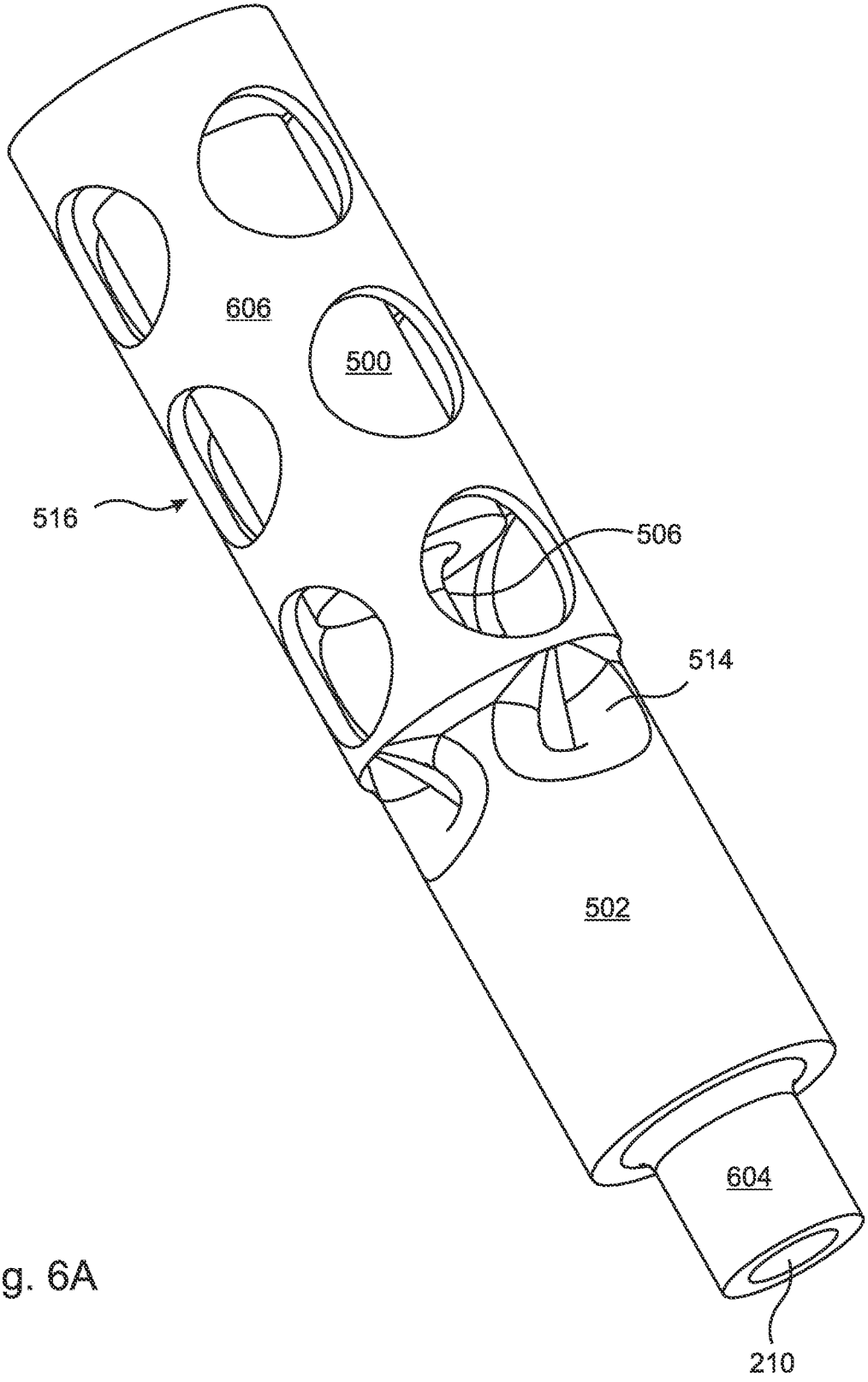
FIG. 6A is a perspective side view of a torch in another embodiment of the present invention.

FIG. 6A is a perspective view of an embodiment that functions in a manner similar to FIGS. 5A-5E, but wherein the liquid fuel is routed through the valve seat 502 such that it does not directly impact the plug 504 as the liquid fuel 512 flows from the standpipe 208 into the holding tank 116. Instead, with reference to the cross-sectional drawing of FIG. 6B, the plug 504 is suspended within a plug chamber 600 that is in liquid communication with the flow of liquid into the fuel tank 116, but is located below the flow path of the liquid fuel 512, so that the plug 504 is offset from the flow path. This approach avoids any concern that rapidly flowing liquid during filling of the fuel tank 116 could push the plug 504 upward into the seat 502 before it is lifted by the float 500, thereby prematurely closing the valve 518, and possible leading to repetitive closing and opening of the valve 518 as it is filled.

Figure 6B:
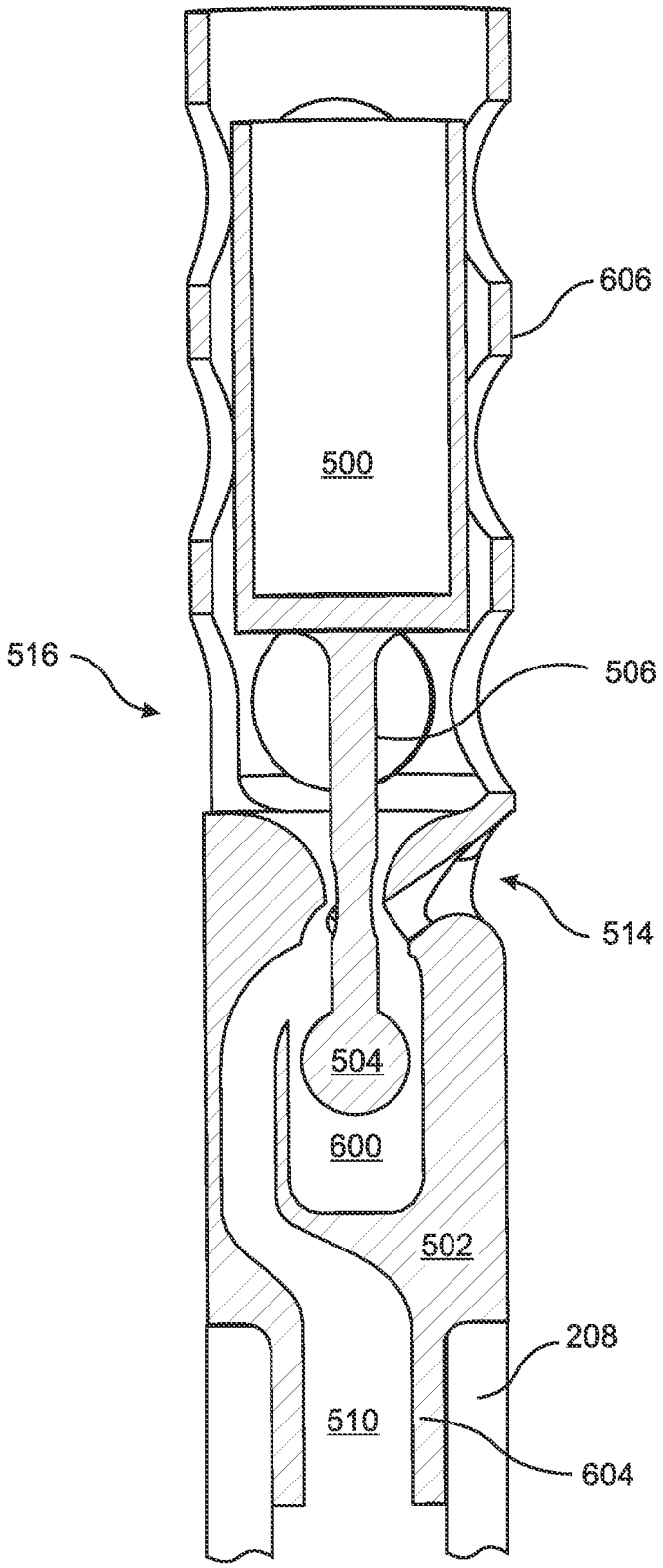
FIG. 6B is a cross-sectional side view of the embodiment of FIG. 6A, shown with the FOP valve in an open state.
Figure 6C:
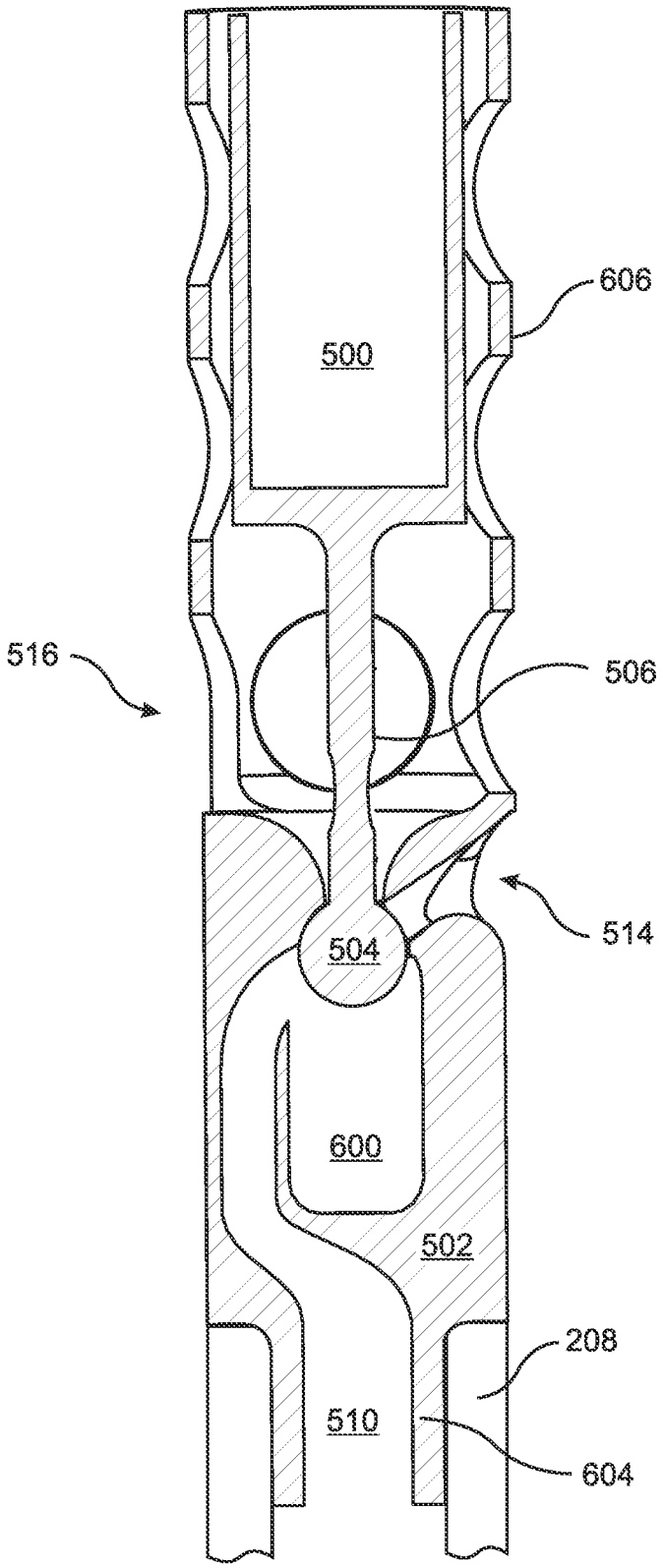
FIG. 6C is a cross-sectional side view of the embodiment of FIG. 6B, shown in a closed state.

FIG. 6B shows the valve 518 in its open configuration, while FIG. 6C is a cross-sectional drawing illustrating the embodiment of FIG. 6B when the valve 518 is closed.

Figure 6D:
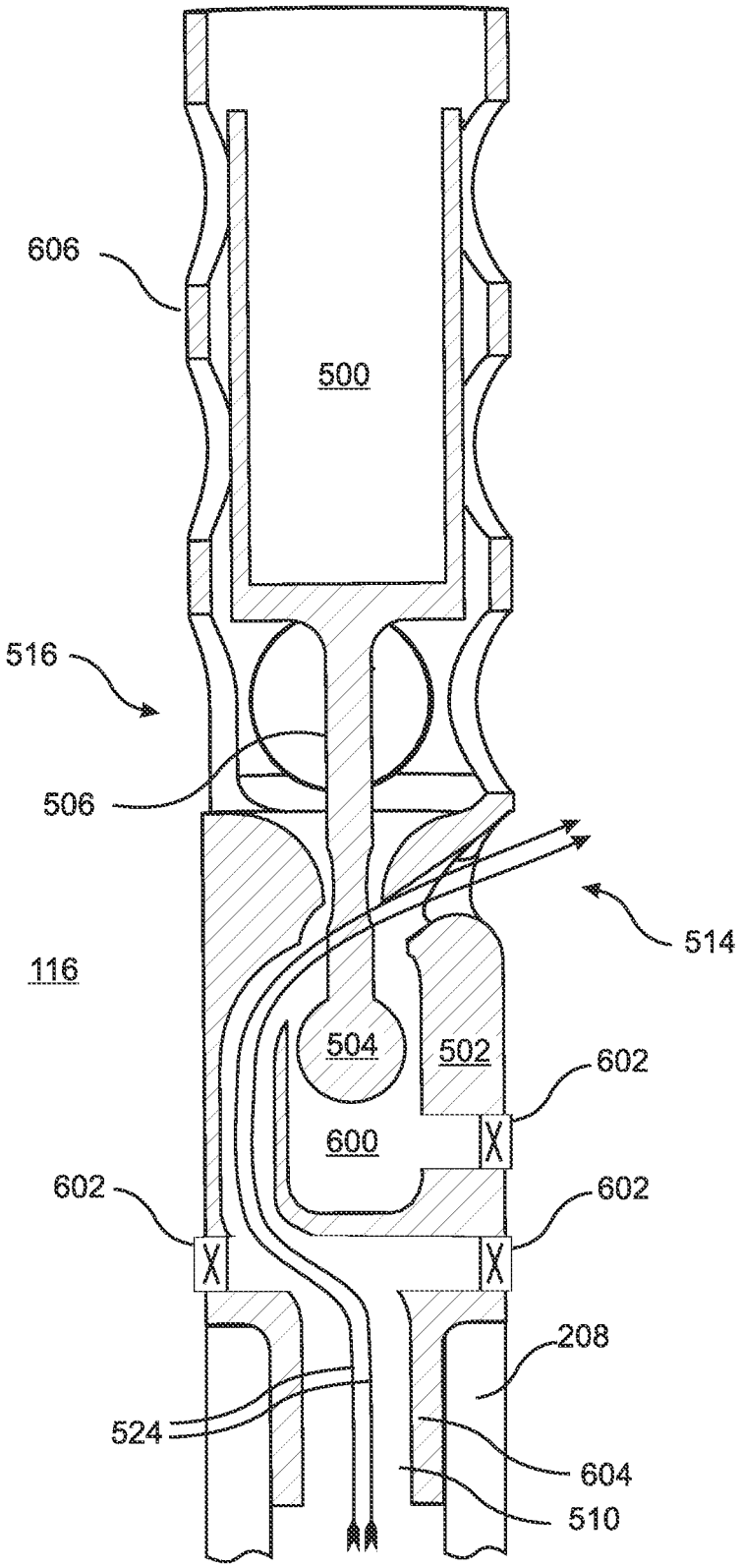
FIG. 6D is a cross-sectional side view of an embodiment similar to the embodiment of FIGS. 6A-6C, but further including a check valve that is configured to enable draining of the holding tank when pressure is withdrawn from the standpipe, even if the FOP valve is closed.

With reference to FIG. 6D, embodiments of the present invention further include a check valve 602 that allows the liquid fuel 512 to be pumped out of the fuel tank 116 even if the FOP valve 518 is closed. The check valve 602 is normally closed so long as there is liquid pressure within the standpipe 208. However, the check valve 602 is configured to automatically open when the liquid pressure within the standpipe 208 drops below a specified threshold pressure, thereby allowing any liquid that is within the fuel tank 116 to drain out of the holding tank 116, even if the valve 518 is closed, if the liquid fuel 512 is withdrawn from the standpipe 208.

Figure 6E:
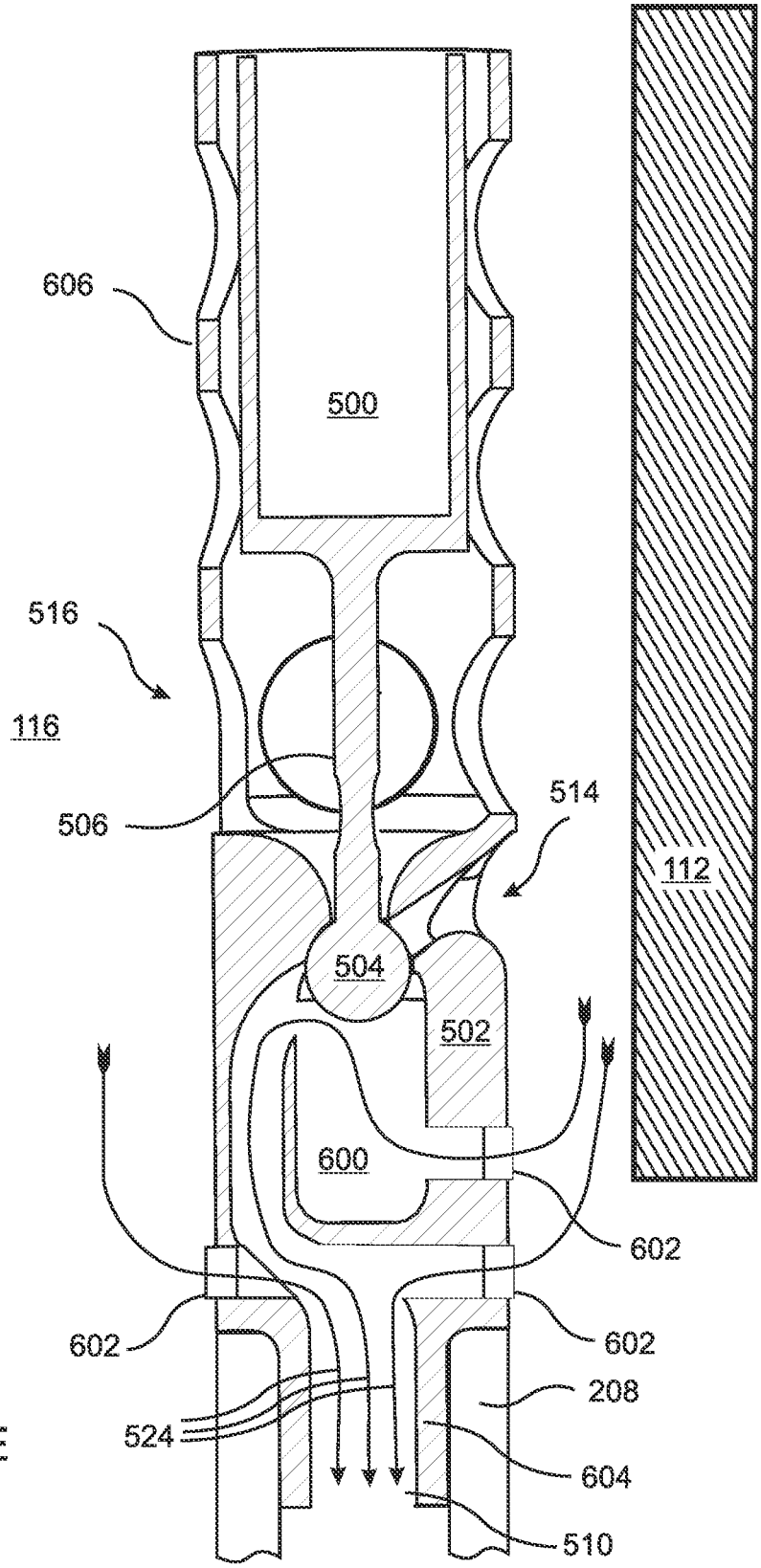
FIG. 6E is a cross-sectional side view of the embodiment of FIG. 6D, showing the fuel draining flow and wick height within the torch.

FIG. 6E is a cross-sectional view of the valve 518 of FIG. 6D illustrating the flow of the liquid fuel 512 out of the fuel tank 116 when the valve 518 is closed and the check valves 602 are open. FIG. 6E further illustrates that this configuration is able to lower the level of the liquid fuel 512 below the bottom of the wick 112. It can also be seen in FIGS. 6D and 6E that a pair of check valves 602 are provided on opposite sides near the bottom of the seat 502. This approach ensures that even if the wick 112 extends nearly to the bottom of the local fuel reservoir 116, it cannot block all of the check valves 602, thereby ensuring that the nearly all of the fuel can be drained from the local fuel reservoir 116, and nearly always below the bottom of the wick 112.

It is notable that in the embodiment of FIGS. 5A-5E the FOP valve 518 is contained entirely within the standpipe 208, while the FOP valve 518 in the embodiment of FIGS. 6A-6E includes a lower stem 604 that is inserted into the standpipe 208, while an upper portion 606 extends beyond the standpipe 208 and has an outer diameter that is equal to the outer diameter of the standpipe 208.

Figure 7A:
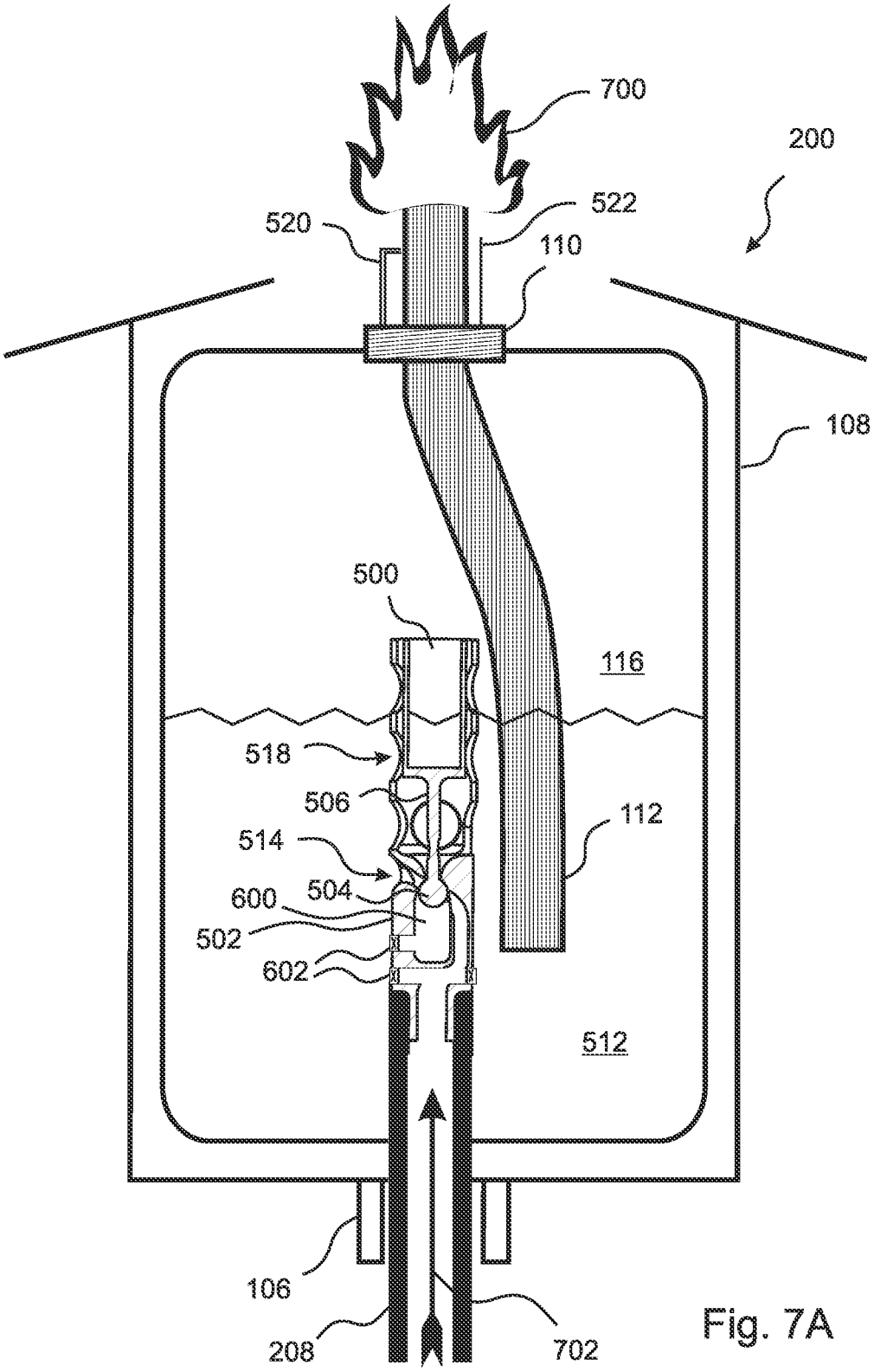
FIG. 7A is a cross sectional side view of a torch that includes the FOP valve of FIG. 6E, shown with the FOP valve closed and a positive fuel pressure applied through the standpipe.

FIGS. 7A through 7D illustrate the process of extinguishing a flame 700 by reversing the pressure of the liquid fuel 512 in the standpipe 208. FIG. 7A is a cross-sectional side view of a torch that includes the FOP valve 518 of FIG. 6D, shown with the fuel reservoir 116 filled with fuel 512, the FOP valve 518 closed, a flame 700 burning at the top of the wick 112, and a positive fuel pressure 702 applied via the standpipe 208. In this configuration, the FOP valve, 518 in combination with the applied positive fuel pressure, ensures that the liquid fuel 512 remains filled at substantially a constant level in the fuel reservoir 116.

Figure 7B:
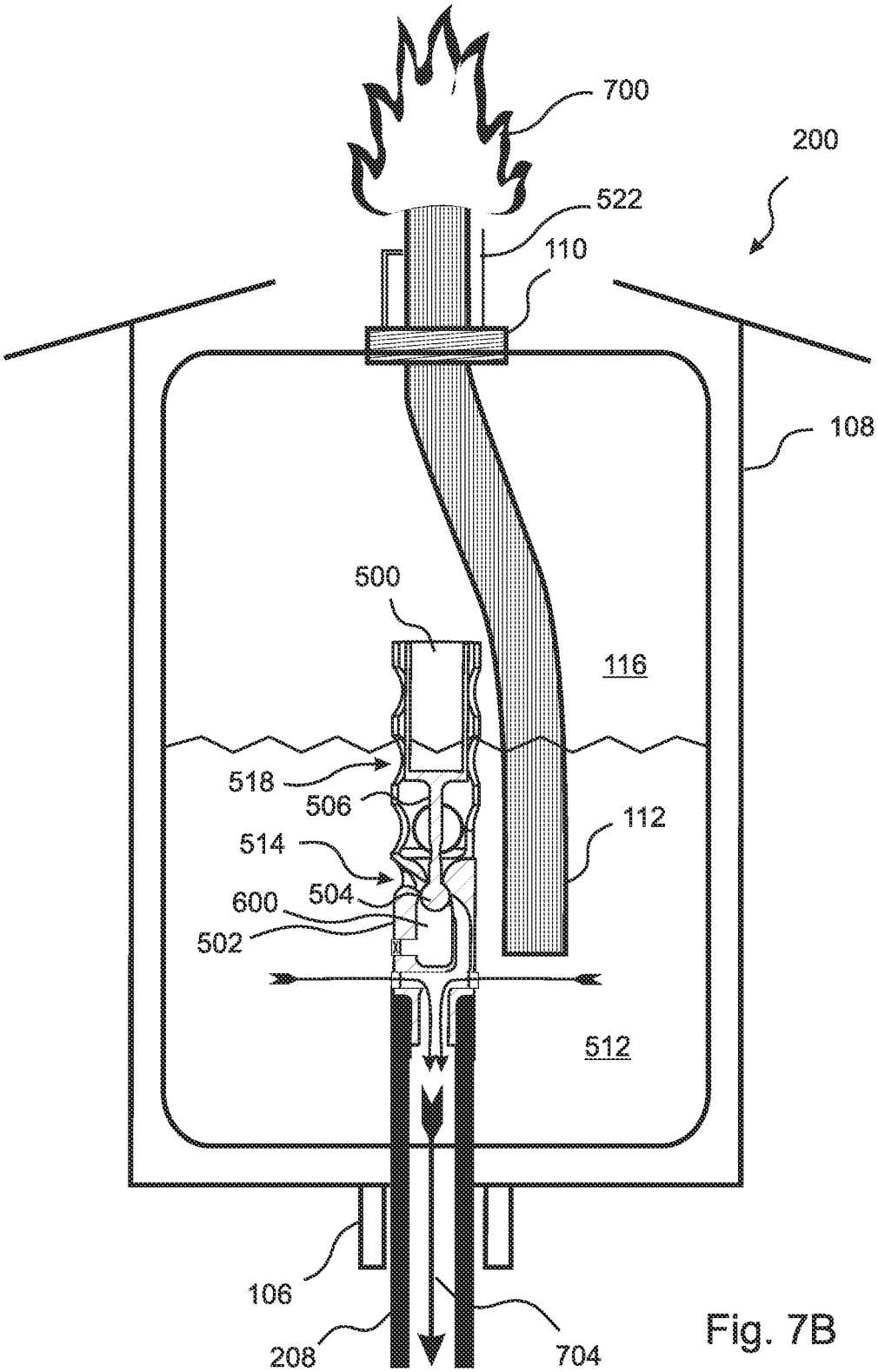
FIG. 7B is a cross sectional side view of the torch o FIG. 7A, shown with a negative fuel pressure applied through the standpipe and fuel beginning to flow out of the torch through the check valves of the FOP valve.

FIG. 7B is a cross-sectional side view similar to FIG. 7A, except that a negative fuel pressure 704 is applied via the standpipe 208, causing the check valves 602 to open so that liquid fuel 512 can begin to flow out of the fuel reservoir 116 through the FOP valve 518 and into the standpipe 208. At this point, the FOP valve 518 remains closed and the wick 112 remains ignited.

Figure 7C:
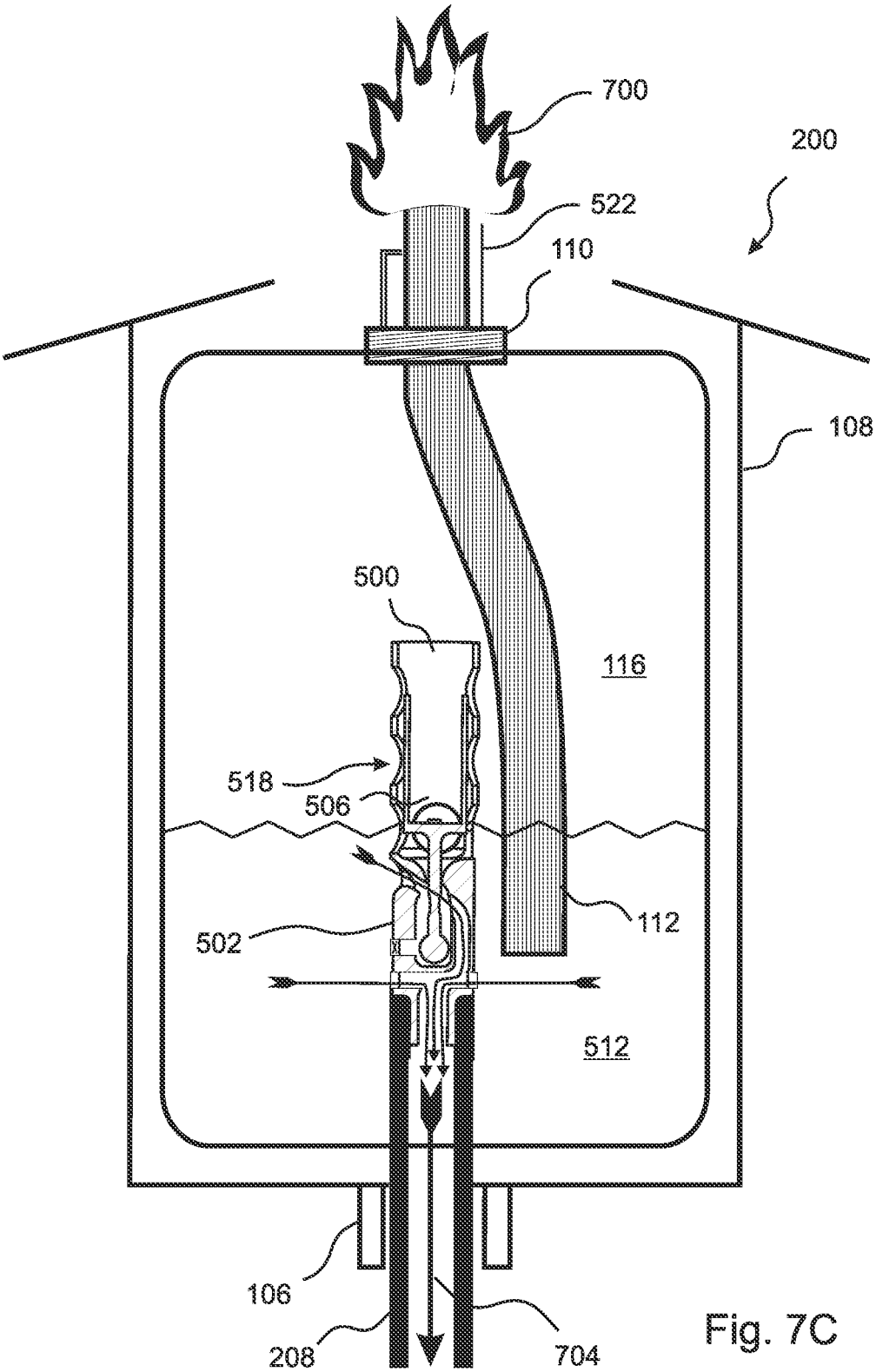
FIG. 7C is a cross sectional side view of the torch o FIG. 7B, shown with a negative fuel pressure applied through the standpipe and fuel flowing out of the torch through the check valves and through the fill port of the FOP valve.

FIG. 7C is a cross-sectional side view of the torch of FIG. 7B, shown after sufficient liquid fuel 512 has been removed from the fuel reservoir 116 to cause the FOP valve 518 to open. At this point, fuel 512 is flowing out of the fuel reservoir 116 both through the check valves 602 and through the fill hole 514. At this point, the wick 112 remains in contact with the fuel 512, and the flame 700 remains ignited.

Figure 7D:
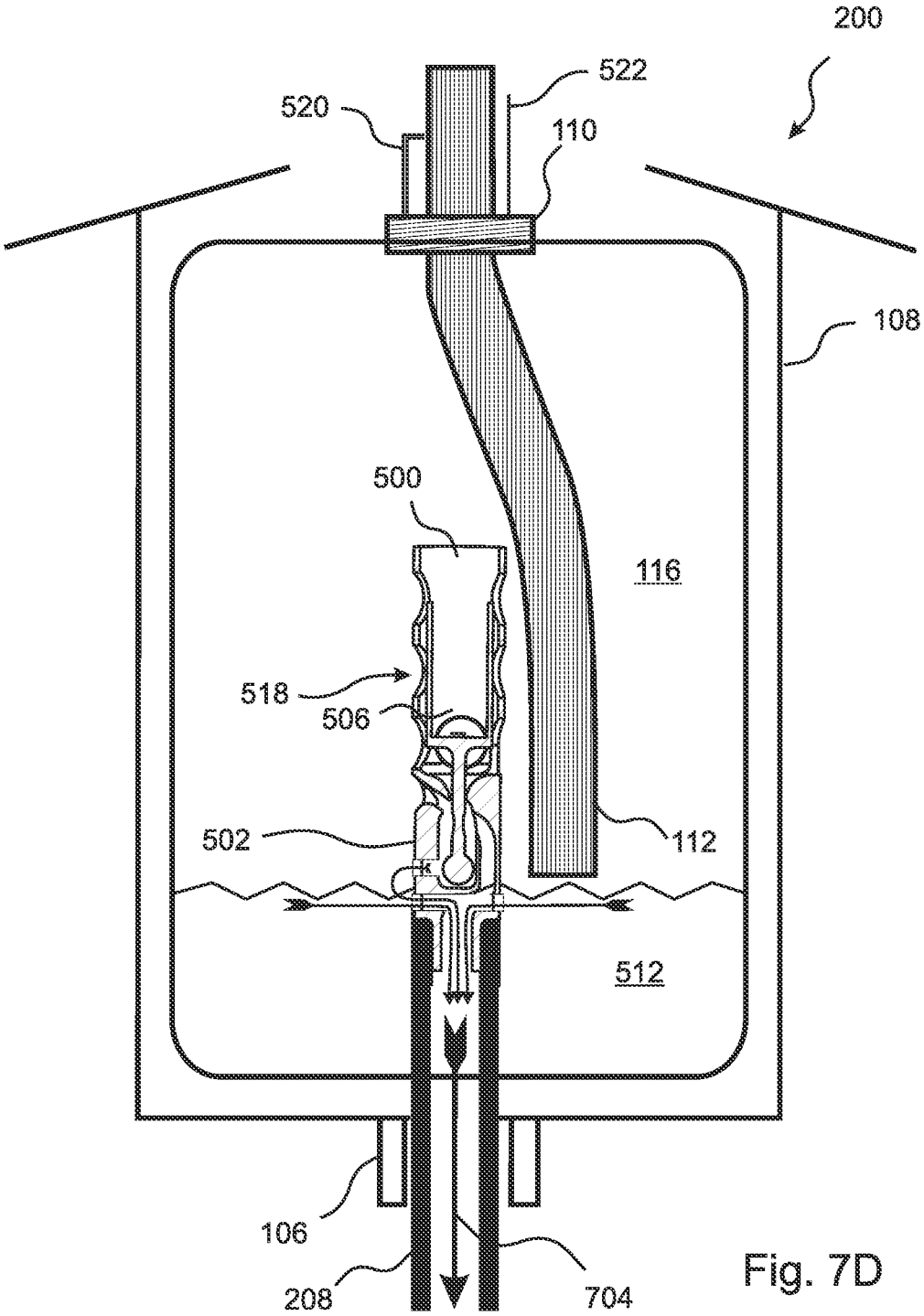
FIG. 7D is a cross sectional side view of the torch o FIG. 7C, shown after the torch has been emptied of fuel and the flame extinguished.

FIG. 7D is a cross-sectional side view of the torch o FIG. 7C, shown as the fuel 512 has reached the level of the lowest check valve 612, which is below the bottom of the wick 112. In the figure, the remaining fuel in the wick 112 has been exhausted, and the flame 700 has been extinguished.

Figure 8:
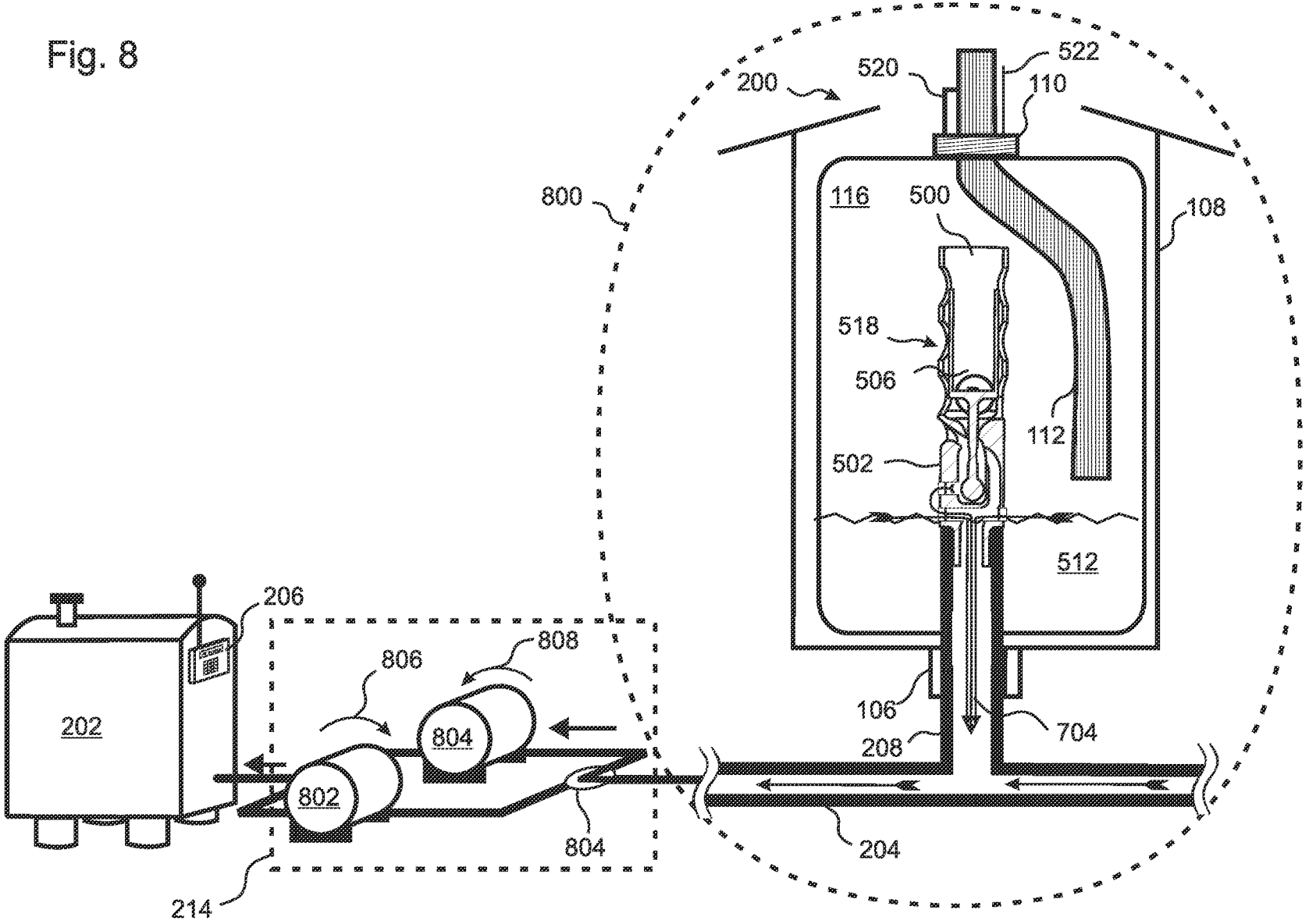
FIG. 8 illustrates an embodiment in which the fuel pumping system includes two pumps, one of which is configured to always pump the liquid fuel in a forward direction, while the other is configured to always pump the liquid fuel in a reverse direction.

FIG. 8 illustrates an embodiment of the present invention in which the fuel pumping system 214 includes two pumps 802, 804, one of which 802 is configured to always pump the liquid fuel in a forward direction 806 from the central reservoir 202 toward the torches 200, while the other of which 804 is configured to always pump the liquid fuel in a reverse direction 808 from the torches 200 to the central reservoir 202. In the illustrated embodiment, further includes a directional valve 804 that can be actuated by the controller 202 to connect either the forward pump 802 or the reverse pump 804 to the torch plumbing system 204. FIG. 8 also includes a magnified region 800 that provides an enlarged cross-sectional view of one of the torches 200 that is in liquid communication with the torch plumbing system 204. The embodiment is shown in a configuration similar to FIG. 7D where the pumping system is in the final stages of removing liquid fuel 512 from the local fuel reservoir 116, the remaining liquid fuel in the wick 112 has been expended, and the flame 700 has been extinguished.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

What is claimed is:

1. A liquid fuel burning torch system that includes automatic refueling of one or more torches and automatic extinguishing of the torches, the liquid fuel burning torch system comprising:

a central fuel reservoir configured to contain a flammable liquid fuel;

at least one torch, each of said torches having a substantially enclosed interior and a local fuel reservoir located within said interior, the local fuel reservoir being configured to contain a local quantity of said liquid fuel, each of said torches further comprising a combustion area exterior to the torch and configured for burning said liquid fuel when drawn by a wick from said local quantity into said combustion area; and a torch refueling system comprising:

a torch plumbing system that provides liquid communication between the central fuel reservoir and the standpipes, thereby providing liquid communication between the central fuel reservoir and the local fuel reservoirs of said torches; a plurality of standpipes in liquid communication with the torch plumbing system and with the torches, each of said torches being supported by one of the vertical standpipes;

a fuel pumping system comprising at least one pump; and a controller that is configured, when the torches are in use, to maintain fuel within the local fuel reservoirs of the torches by causing the fuel pumping system to pump the fuel in a forward flow direction from the central reservoir through the torch plumbing system and the standpipes to the local fuel reservoirs of each of the torches;

the torches, while interconnected with each other by the torch plumbing system and standpipes, being otherwise structurally independent and separate from each other and from the central reservoir;

said controller being further configured to extinguish the torches by causing the fuel pumping system to reverse the flow direction of the fuel in the torch plumbing system and standpipes, so that the fuel is pumped from the local fuel reservoirs of the torches through the standpipes and the torch plumbing system to the central fuel reservoir, thereby at least partially emptying the local fuel reservoirs of the torches.

2. The liquid fuel burning torch system of claim 1, wherein the fuel pumping system includes only one pump, and the controller is able to reverse the flow direction of the fuel in the torch plumbing system and standpipes by reversing a pumping direction of the pump.

3. The liquid fuel burning torch system of claim 1, wherein:

the fuel pumping system includes only one pump that is configured to only operate in a forward pumping direction;

the liquid fuel burning torch system further comprises a plurality of flow reversal valves configured, when actuated, to connect an input of the pump to the torch plumbing system while connecting an output of the pump to the central reservoir; and the controller is able to reverse the flow direction of the fuel in the torch plumbing system and standpipes by actuating the flow reversal valves.

4. The liquid fuel burning system of claim 1, wherein the fuel pumping system includes a first pump that is configured to only operate in the forward pumping direction, and a second pump that is configured to only operate in a reverse pumping direction, and wherein causing the fuel pumping system to reverse the flow direction of the fuel in the torch plumbing system and standpipes includes redirecting the fuel so that it flows through the second pump instead of through the first pump.

5. The liquid fuel burning torch system of claim 1, wherein the controller includes wireless access that enables at least one of remote monitoring and remote control of the liquid fuel burning torch system.

6. The liquid fuel burning torch system of claim 5, wherein the liquid fuel burning torch system can be remotely monitored and/or controlled via a software application that operates on a hand-held electronic device.

7. The liquid fuel burning torch system of claim 1, wherein at least one of the torches further comprises a torch igniting system that is configured to ignite the torch under control of the controller.

8. The liquid fuel burning torch system of claim 1, wherein at least one of the torches further comprises a heat sensor located in or proximal to the combustion area, the heat sensor being in electronic communication with the controller, thereby enabling the controller to determine whether the torch has been extinguished.

9. The liquid fuel burning torch system of claim 1, wherein:

at least one of the torches includes a fuel overfill prevention (FOP) valve having a FOP valve plug within an internal passage that is lifted toward a seat by a float when a fuel level within the local fuel reservoir rises above the float, thereby closing the FOP valve when the float reaches a maximum fuel level and the plug is sealed against the seat;

the FOP valve, when open, being configured to allow the liquid fuel to flow from the standpipe through the internal passage of the FOP valve, through a fill port of the FOP valve, and into the local fuel reservoir;

the FOP valve, when closed, being configured to prevent the liquid fuel from flowing into the local fuel reservoir from the standpipe.

10. The liquid fuel burning torch system of claim 9, wherein the internal passage of the FOP valve is configured to direct a flow of the liquid through a flow path to the fill port without the flow path directly impinging on the FOP valve plug.

11. The liquid fuel burning torch system of claim 9, further comprising a check valve that is located below the seat of the FOP valve and is configured to remain closed when a pressure of the liquid fuel in the local fuel reservoir is less than or equal to a pressure of the liquid fuel within the standpipe, and to automatically open and allow the liquid fuel to flow from the local fuel reservoir into the standpipe when the FOP valve is closed and a pressure of the liquid fuel in the local fuel reservoir is greater than a pressure of the liquid fuel within the standpipe by more than a threshold pressure difference.

12. A method of igniting, maintaining, and extinguishing a torch included in a liquid fuel burning torch system, the method comprising:

providing a liquid fuel burning torch system according to claim 1;

for at least one of the torches included in the liquid fuel burning torch system, causing the fuel pumping system to pump the liquid fuel in a forward flow direction from the central reservoir through the torch plumbing system and the standpipes to the local fuel reservoir of the torch;

igniting the torch;

during a torch usage period, causing the fuel pumping system to pump the liquid fuel in the forward flow direction through the torch plumbing system and standpipes, thereby refilling the local fuel reservoir of the torch, as needed, to maintain communication between the wick and the liquid fuel within the local fuel reservoir of the torch; and upon termination of the torch usage period, causing the fuel pumping system to pump the liquid fuel in a reverse flow direction through the torch plumbing system and standpipes, thereby at least partially emptying the liquid fuel from the local fuel reservoir of the torch, so that the wick is isolated from direct contact with the liquid fuel in the local fuel reservoir, and thereby causing the torch to be extinguished once any liquid fuel remaining in the wick has been consumed.

13. The method of claim 12, wherein the fuel pumping system includes only one pump, and wherein the step of causing the fuel pumping system to pump the liquid fuel in the reverse flow direction includes reversing a pumping direction of the pump.

14. The method of claim 12, wherein the fuel pumping system includes only one pump in liquid communication with a plurality of flow reversal valves, and wherein the step of causing the fuel pumping system to pump the liquid fuel in the reverse flow direction includes actuating the flow reversal valves so as to connect an input of the pump to the torch plumbing system while connecting an output of the pump to the central reservoir.

15. The method of claim 12, wherein the fuel pumping system includes a first pump that is configured to only operate in the forward pumping direction, and a second pump that is configured to only operate in a reverse pumping direction, and wherein the step of causing the fuel pumping system to pump the liquid fuel in the reverse flow direction includes redirecting the fuel so that it flows through the second pump instead of through the first pump.

16. The method of claim 12, wherein the torch further comprises a torch igniting system that is configured to ignite the torch under control of the controller, and wherein the step of igniting the torch includes the controller causing the torch igniting system to ignite the torch.

17. The method of claim 12, wherein the torch further comprises a heat sensor located in or proximal to the combustion area, the heat sensor being in electronic communication with the controller, and wherein the method further comprises the controller determining when the torch has been extinguished according to information received by the controller from the heat sensor.

18. The method of claim 17, further comprising, once the controller has determined that the torch has been extinguished, the controller causing the fuel pumping system to pump the liquid fuel in the forward flow direction through the torch plumbing system, thereby at least partially refilling the internal fuel reservoir of the torch.

19. The method of claim 12, wherein:

the torch includes a fuel overfill prevention (FOP) valve having a FOP valve plug within an internal passage that is lifted toward a seat by a float when a fuel level within the local fuel reservoir rises above the float, thereby closing the FOP valve when the float reaches a maximum fuel level and the plug is sealed against the seat;

the FOP valve, when open, being configured to allow the liquid fuel to flow from the standpipe through the internal passage of the FOP valve, through a fill port of the FOP valve, and into the local fuel reservoir;

the FOP valve, when closed, being configured to prevent the liquid fuel from flowing into the local fuel reservoir from the standpipe.

20. The method of claim 19, wherein the internal passage of the FOP valve is configured to direct a flow of the liquid fuel through a flow path to the fill port without the flow path directly impinging on the FOP valve plug.

21. The method of claim 19, wherein the FOP valve further comprises a check valve that is located below the seat and is configured to remain closed when a pressure of the liquid fuel in the local fuel reservoir is less than or equal to a pressure of the liquid fuel within the standpipe, and to automatically open and allow the liquid fuel to flow from the local fuel reservoir into the standpipe when the FOP valve is closed and a pressure of the liquid fuel in the local fuel reservoir is greater than a pressure of the liquid fuel within the standpipe by more than a threshold pressure difference.

* * * * *